US012071741B2

(12) United States Patent
Itoh et al.

(10) Patent No.: US 12,071,741 B2
(45) Date of Patent: Aug. 27, 2024

(54) SHOVEL

(71) Applicant: SUMITOMO HEAVY INDUSTRIES, LTD., Tokyo (JP)

(72) Inventors: Takumi Itoh, Kanagawa (JP); Masaru Onodera, Kanagawa (JP)

(73) Assignee: SUMITOMO HEAVY INDUSTRIES, LTD., Tokyo (JP)

( * ) Notice: Subject to any disclaimer, the term of this patent is extended or adjusted under 35 U.S.C. 154(b) by 517 days.

(21) Appl. No.: 17/444,215

(22) Filed: Aug. 2, 2021

(65) Prior Publication Data

US 2021/0355651 A1 Nov. 18, 2021

Related U.S. Application Data

(63) Continuation of application No. PCT/JP2020/004045, filed on Feb. 4, 2020.

(30) Foreign Application Priority Data

Feb. 4, 2019 (JP) ..... 2019-018048

(51) Int. Cl.

| | |
|---|---|
| ***E02F 3/32*** | (2006.01) |
| ***E02F 3/43*** | (2006.01) |
| *E02F 9/22* | (2006.01) |

(52) U.S. Cl.

CPC ..... *E02F 3/435* (2013.01); *E02F 3/32* (2013.01); *E02F 9/2267* (2013.01)

(58) Field of Classification Search

CPC . E02F 9/262; E02F 3/437; E02F 3/439; E02F 9/2235; E02F 3/32; E02F 9/2228; E02F 3/438; E02F 3/435; E02F 9/2267

See application file for complete search history.

(56) References Cited

U.S. PATENT DOCUMENTS

| | | | |
|---|---|---|---|
| 4,037,337 | A | 7/1977 | Hemphill |
| 4,123,861 | A | 11/1978 | Hemphill |
| 4,200,423 | A | 4/1980 | Sornsin |

(Continued)

FOREIGN PATENT DOCUMENTS

| | | |
|---|---|---|
| CN | 208136981 U | 11/2018 |
| DE | 69737449 | 11/2007 |

(Continued)

OTHER PUBLICATIONS

Guzmán et al., Integrated Mechanical-Electrical Modeling of an AC Electric Mining Shovel and Evaluation of Power Requirements During a Truck Loading Cycle, 1915, IEEE, p. 2590-2599 (Year: 1915).*

(Continued)

*Primary Examiner* — McDieunel Marc
(74) *Attorney, Agent, or Firm* — IPUSA, PLLC

(57) ABSTRACT

A shovel includes a lower traveling structure, an upper swing structure swingably mounted on the lower traveling structure, an attachment attached to the upper swing structure and including a boom, an arm, and a bucket, and processing circuitry. The processing circuitry is configured to cause the shovel to automatically perform work by causing the upper swing structure and the attachment to automatically operate. The work is at least one of the work of banking earth and the work of filling with earth.

14 Claims, 10 Drawing Sheets

(56) References Cited

U.S. PATENT DOCUMENTS

| | | | | |
|---|---|---|---|---|
| 4,871,292 | A | 10/1989 | Milanowski | |
| 5,179,794 | A | 1/1993 | Ballinger | |
| 5,678,332 | A | 10/1997 | Hawkins | |
| 6,076,029 | A | 6/2000 | Watanabe et al. | |
| 6,088,938 | A | 7/2000 | Logan | |
| 6,336,077 | B1 | 1/2002 | Boucher | |
| 7,621,689 | B2 | 11/2009 | Nishioka et al. | |
| 10,184,224 | B2 * | 1/2019 | Ito | E02F 3/3663 |
| 10,538,897 | B2 | 1/2020 | Jetake et al. | |
| 2003/0226291 | A1 | 12/2003 | Naruse et al. | |
| 2005/0102866 | A1 | 5/2005 | Sewell et al. | |
| 2006/0230752 | A1 | 10/2006 | Sawada | |
| 2009/0071667 | A1 | 3/2009 | Cox et al. | |
| 2009/0282710 | A1 * | 11/2009 | Johnson | E02F 3/404 37/444 |
| 2011/0257816 | A1 | 10/2011 | Song et al. | |
| 2012/0158234 | A1 | 6/2012 | Choi | |
| 2013/0074377 | A1 | 3/2013 | Colbert | |
| 2015/0240446 | A1 | 8/2015 | Takaura | |
| 2016/0060843 | A1 | 3/2016 | Trotnow | |
| 2016/0251823 | A1 | 9/2016 | Paull | |
| 2016/0258135 | A1 | 9/2016 | Shimano et al. | |
| 2017/0107687 | A1 * | 4/2017 | Ito | E02F 3/3618 |
| 2017/0247860 | A1 | 8/2017 | Lehtinen et al. | |
| 2017/0298591 | A1 | 10/2017 | Imaizumi et al. | |
| 2018/0002899 | A1 * | 1/2018 | Morimoto | E02F 3/43 |
| 2018/0079404 | A1 | 5/2018 | Kaneko et al. | |
| 2019/0194903 | A1 | 6/2019 | Nadaoka et al. | |
| 2019/0226175 | A1 * | 7/2019 | Mairet | E02F 3/422 |
| 2021/0079625 | A1 | 3/2021 | Narikawa et al. | |

FOREIGN PATENT DOCUMENTS

| | | |
|---|---|---|
| EP | 2725149 | 4/2014 |
| EP | 3363955 | 8/2018 |
| EP | 3779071 | 2/2021 |
| JP | H03-295935 | 12/1991 |
| JP | H11-034719 | 2/1999 |
| JP | H11-247220 | 9/1999 |
| JP | 3061529 | 7/2000 |
| JP | 2004-162275 | 6/2004 |
| JP | 2004-238874 | 8/2004 |
| JP | 2005-061024 | 3/2005 |
| JP | 2006-214236 | 8/2006 |
| JP | 3833163 | 10/2006 |
| JP | 2016-008477 | 1/2016 |
| JP | 2016-130409 | 7/2016 |
| JP | 2017-082472 | 5/2017 |
| JP | 2018-128422 | 8/2018 |
| JP | 2018-168640 | 11/2018 |
| WO | 93/01366 | 1/1993 |
| WO | 2013/034516 | 3/2013 |
| WO | 2014/051170 | 4/2014 |
| WO | 2016/151965 | 9/2016 |
| WO | 2017/036932 | 3/2017 |
| WO | 2018/155202 | 8/2018 |
| WO | 2018/174154 | 9/2018 |
| WO | 2018/180555 | 10/2018 |
| WO | 2019/009341 | 1/2019 |

OTHER PUBLICATIONS

Bares et al., A robotic excavator for autonomous truck loading, 1998, IEEE, p. 1885-1893 (Year: 1998).*

Kang et al., Path tracking for a hydraulic excavator utilizing proportional-derivative and linear quadratic control, 2014, IEEE, p. 808-813 (Year: 2014).*

Yamamoto et al., Development of the autonomous hydraulic excavator prototype using 3-D information for motion planning and control, 2010, IEEE, p. 49-54 (Year: 2010).*

International Search Report for PCT/JP2020/004045 mailed on Apr. 7, 2020.

International Search Report for PCT/JP2020/005640 mailed on Apr. 21, 2020.

Yukio et al., JP3061529B.translate. English, Hydraulic Drive Gear of Hydraulic Shovel Equipped With Loaderfront, Hitachi Constr Mach Co Ltd. (Year: 2000).

* cited by examiner

SHOVEL

CROSS-REFERENCE TO RELATED APPLICATIONS

This application is a continuation application filed under 35 U.S.C. 111(a) claiming benefit under 35 U.S.C. 120 and 365(c) of PCT International Application No. PCT/JP2020/004045, filed on Feb. 4, 2020 and designating the U.S., which is based upon and claims priority to Japanese Patent Application No. 2019-018048, filed on Feb. 4, 2019. The entire contents of the foregoing applications are incorporated herein by reference.

BACKGROUND

Technical Field

The present disclosure relates to shovels.

Description of Related Art

For example, a shovel that automatically performs excavation work is known.

SUMMARY

According to an embodiment, a shovel includes a lower traveling structure, an upper swing structure swingably mounted on the lower traveling structure, an attachment attached to the upper swing structure and including a boom, an arm, and a bucket, and processing circuitry. The processing circuitry is configured to cause the shovel to automatically perform work by causing the upper swing structure and the attachment to automatically operate. The work is at least one of the work of banking earth and the work of filling with earth.

DETAILED DESCRIPTION

Shovels may be required to perform works other than excavation. For example, shovels may perform work to fill depressions in the ground with earth, such as ground leveling work and backfilling work. Furthermore, for example, shovels may perform banking work to bank earth on the ground to elevate the ground. Therefore, shovels are desired to automatically perform the work of banking earth and the work of filling with earth.

According to an embodiment, it is possible to provide a shovel that can automatically perform the work of banking earth or the work of filling with earth.

An embodiment is described below with reference to the accompanying drawings.

[Shovel Overview]

An overview of a shovel 100 according to this embodiment is described with reference to FIGS. 1A and 1B.

Figure 1A:
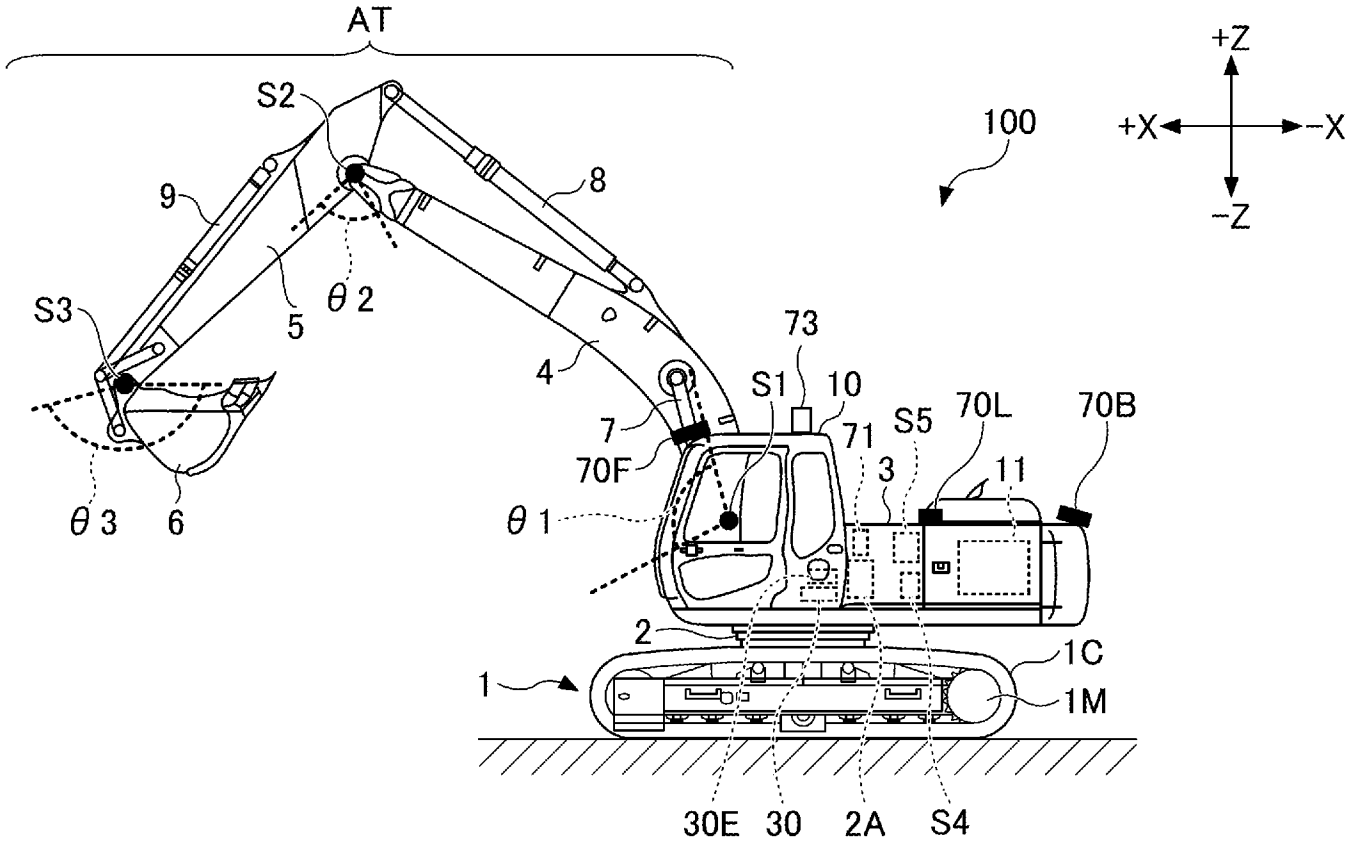
FIG. 1A is a side view of a shovel.
Figure 1B:
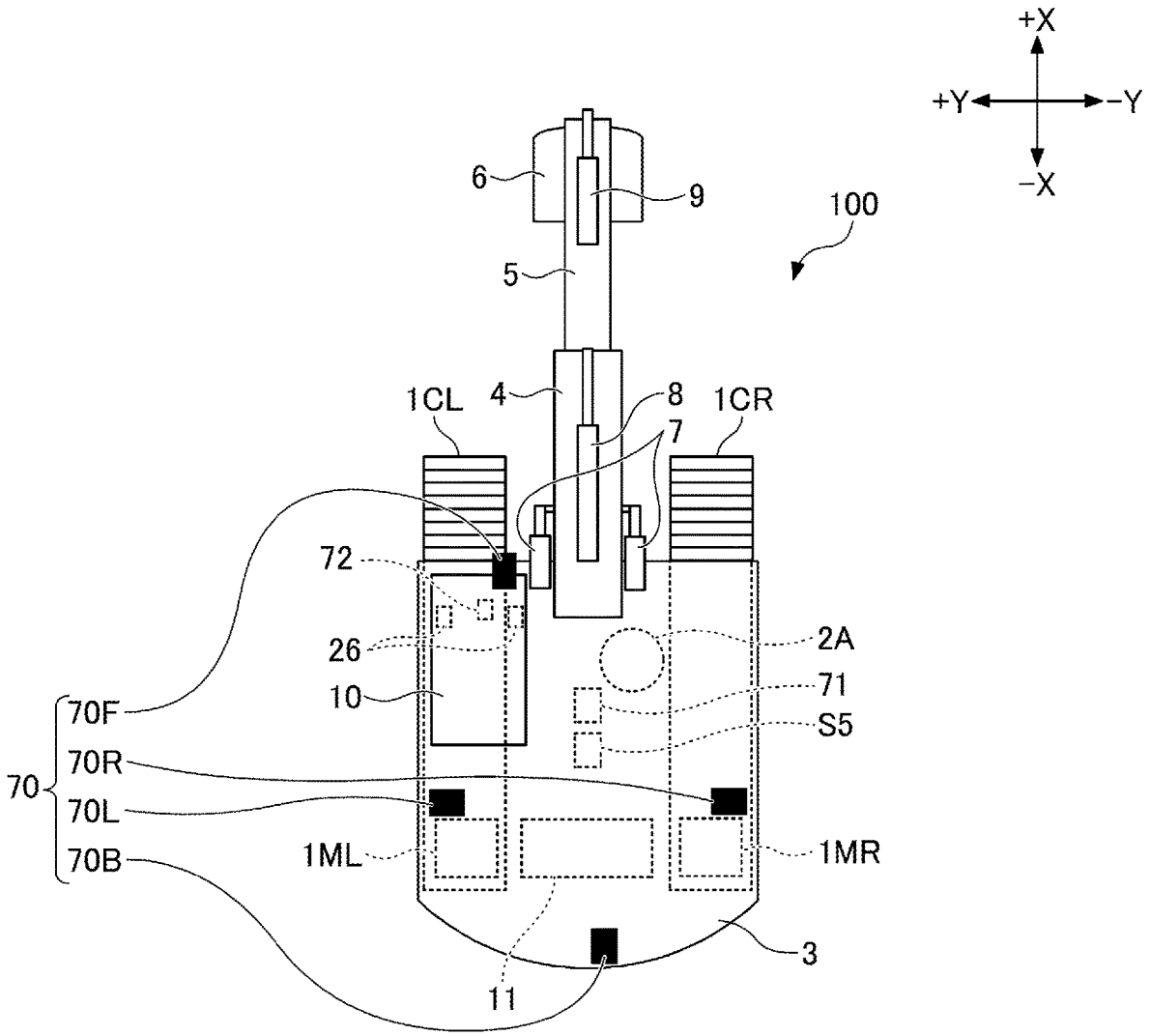
FIG. 1B is a plan view of the shovel.

FIGS. 1A and 1B are a side view and a plan view of the shovel 100 according to this embodiment.

The shovel 100 according to this embodiment includes a lower traveling structure 1; an upper swing structure 3 swingably mounted on the lower traveling structure 1 via a swing mechanism 2; a boom 4, an arm 5, and a bucket 6 that constitute an attachment AT, and a cabin 10 in which an operator rides. Hereinafter, the front side of the shovel 100 corresponds to a direction in which the attachment AT extends relative to the upper swing structure 3 in a plan view of the shovel 100 taken from directly above along the swing axis of the upper swing structure 3 (hereinafter simply referred to as "plan view"). Furthermore, the left side and the right side of the shovel 100 corresponds to the left side and the right side, respectively, of the operator in the cabin 10.

The lower traveling structure 1 includes, for example a pair of left and right crawlers 1C (namely, a left crawler 1CL and a right crawler 1CR). The lower traveling structure 1 has the crawlers 1C (1CL, 1CR) hydraulically driven by travel hydraulic motors 1M (namely, a left travel hydraulic motor 1ML and a right travel hydraulic motor 1MR) to cause the shovel 100 to travel.

The swing mechanism 2 is hydraulically driven by a swing hydraulic motor 2A to swing the upper swing structure 3 relative to the lower traveling structure 1.

The boom 4 is pivotally attached to the front center of the upper swing structure 3 to be able to rise and lower. The arm 5 is pivotally attached to the distal end of the boom 4 to be able to pivot upward and downward. The bucket 6 is pivotally attached to the distal end of the arm 5 to be able to pivot upward and downward.

The boom 4, the arm 5, and the bucket 6 are hydraulically driven by a boom cylinder 7, an arm cylinder 8, and a bucket cylinder 9, respectively, which serve as hydraulic actuators.

The cabin 10 is an operation room in which the operator rides, and is mounted on the front left of the upper swing structure 3.

[Shovel Configuration]

Next, a specific configuration of the shovel 100 is described with reference to FIG. 2 (FIGS. 2A and 2B) in addition to FIG. 1 (FIGS. 1A and 1B).

Figure 2A:
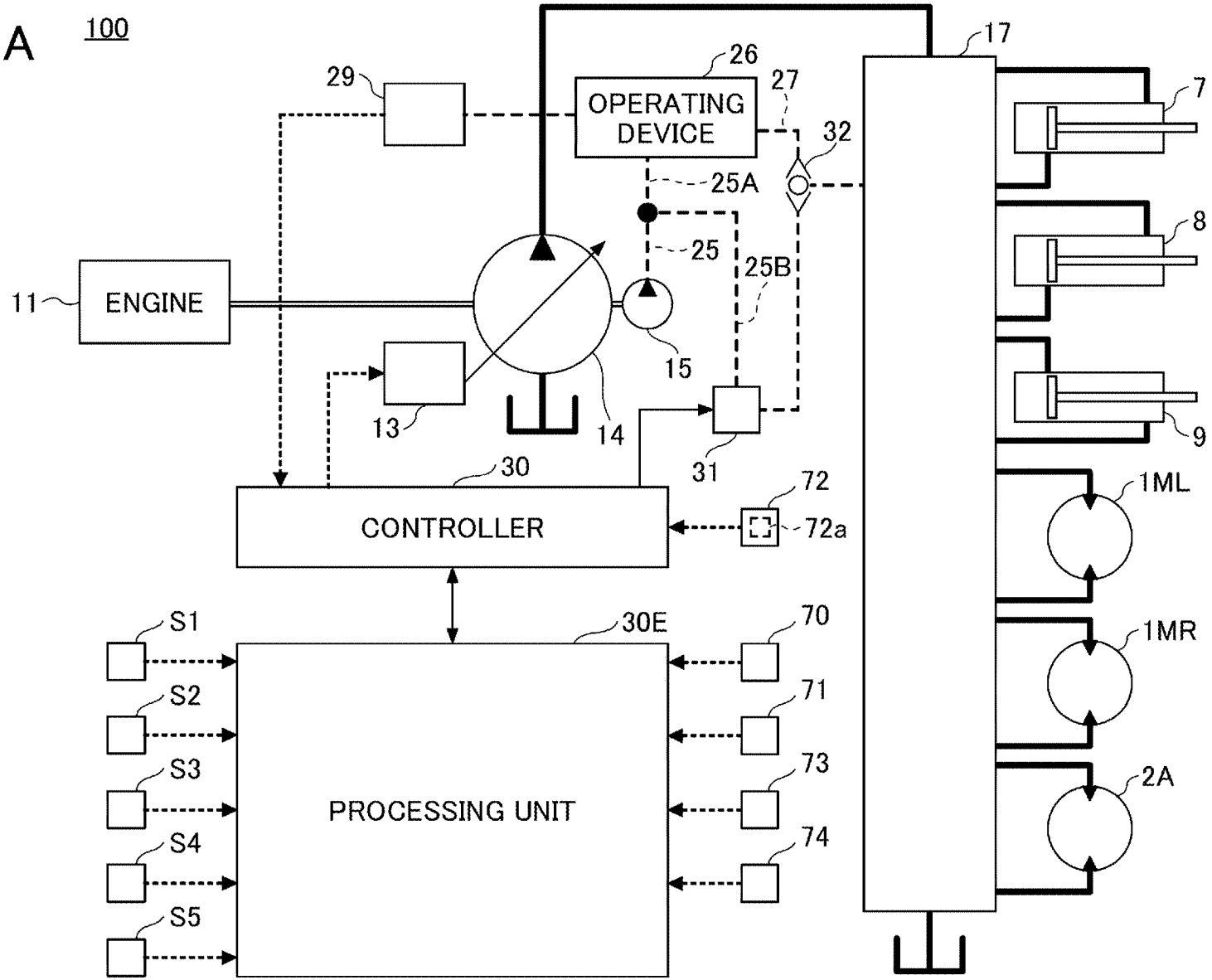
FIG. 2A is a block diagram illustrating an example configuration of the shovel.
Figure 2B:
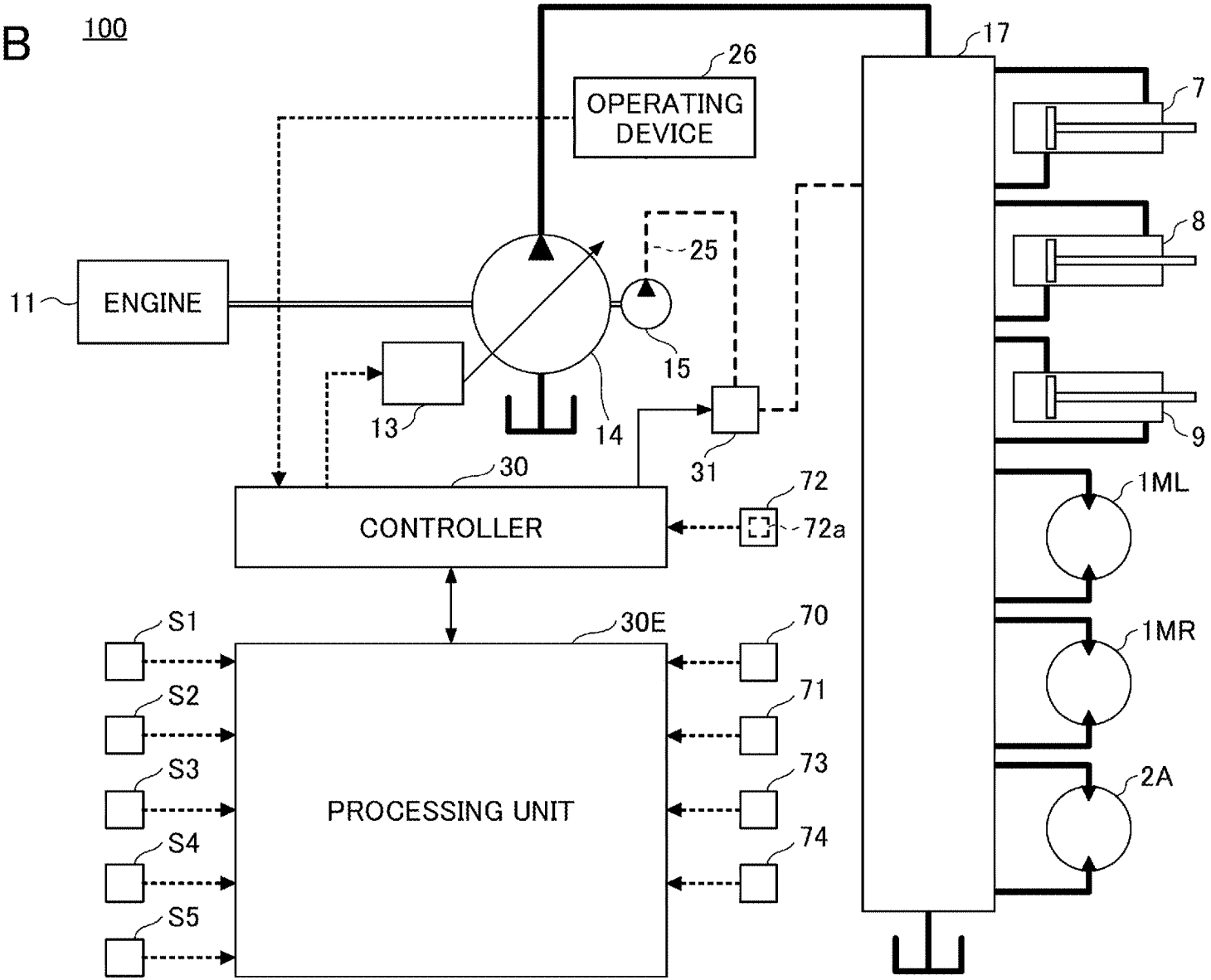
FIG. 2B is a block diagram illustrating another example configuration of the shovel.

FIGS. 2A and 2B are block diagrams illustrating an example and another example configuration of the shovel 100 according to this embodiment.

In the drawings, a mechanical power line, a high-pressure hydraulic line, a pilot line, and an electric drive and control line are indicated by a double line, a solid line, a dashed line, and a dotted line, respectively.

<Hydraulic Drive System of Shovel>

The hydraulic drive system of the shovel 100 according to this embodiment includes hydraulic actuators such as the travel hydraulic motors 1M (1ML, 1MR), the swing hydraulic motor 2A, the boom cylinder 7, the arm cylinder 8, and the bucket cylinder 9 that hydraulically drive the lower traveling structure 1, the upper swing structure 3, the boom 4, the arm 5, and the bucket 6, respectively, as described above. Furthermore, the hydraulic drive system of the shovel 100 according to this embodiment includes an engine 11, a regulator 13, a main pump 14, and a control valve 17.

The engine 11 is a main power source in the hydraulic drive system, and is a diesel engine fueled with diesel fuel. The engine 11 is, for example, mounted on the back of the upper swing structure 3, and constantly rotates at a preset target rotational speed under the direct or indirect control of a below-described controller 30 to drive the main pump 14 and a pilot pump 15.

The regulator 13 controls (adjusts) the discharge quantity of the main pump 14 under the control of the controller 30. For example the regulator 13 adjusts the angle (hereinafter "tilt angle") of the swash plate of the main pump 14 in response to a control command from the controller 30.

The main pump 14 is, for example, mounted on the back of the upper swing structure 3 the same as the engine 11, and supplies hydraulic oil to the control valve 17 through a high-pressure hydraulic line. The main pump 14 is driven by the engine 11 as described above. The main pump 14 is, for example, a variable displacement hydraulic pump, and its discharge flow rate (discharge pressure) is controlled by the regulator 13 controlling the tilt angle of the swash plate to adjust the stroke length of a piston under the control of the controller 30 as described above.

The control valve 17 is, for example, a hydraulic control device mounted in the center of the upper swing structure 3 to control a hydraulic actuator according to the details of the operator's operation on an operating device 26 or a control command corresponding to the automatic operation of the shovel 100 (hereinafter "automatic control command") output from the controller 30. As described above, the control valve 17 is connected to the main pump 14 via a high-pressure hydraulic line to selectively supply hydraulic oil supplied from the main pump 14 to hydraulic actuators (such as the travel hydraulic motors 1M (1ML, 1MR), the swing hydraulic motor 2A, the boom cylinder 7, the arm cylinder 8, and the bucket cylinder 9) according to the operating state of the operating device 26 or an automatic control command output from the controller 30. Specifically, the control valve 17 includes multiple control valves (directional control valves) that control the flow rate and the flow direction of hydraulic oil supplied from the main pump 14 to hydraulic actuators.

<Operation System of Shovel>

The operation system of the shovel 100 related to the hydraulic drive system according to this embodiment includes the pilot pump 15 and the operating device 26. Furthermore, as illustrated in FIG. 2A, the operation system of the shovel 100 related to the hydraulic drive system includes a shuttle valve 32 when the operating device 26 is a hydraulic pilot type.

The pilot pump 15 is, for example, mounted on the back of the upper swing structure 3 the same as the engine 11, and supplies a pilot pressure to various hydraulic devices through a pilot line 25. The pilot pump 15 is, for example, a fixed displacement hydraulic pump, and is driven by the engine 11 as described above.

The operating device 26 is an operation inputting device that is provided near the operator seat of the cabin and serves for the operator to operate various driven elements (the lower traveling structure 1, the upper swing structure 3, the boom 4, the arm 5, the bucket 6, etc.). In other words, the operating device 26 is an operation inputting device for the operator operating hydraulic actuators that drive corresponding driven elements (namely, the travel hydraulic motors 1ML and 1MR, the swing hydraulic motor 2A, the boom cylinder 7, the arm cylinder 8, the bucket cylinder 9, etc.). The operating device 26 includes, for example, lever devices for operating the boom 4 (the boom cylinder 7), the arm 5 (the arm cylinder 8), the bucket 6 (the bucket cylinder 9), and the upper swing structure 3 (the swing hydraulic motor 2A). Furthermore, the operating device 26 includes, for example, pedal devices or lever devices for operating the left and right crawlers 1CL and 1CR (the travel hydraulic motors 1ML and 1MR) of the lower traveling structure 1.

For example, as illustrated in FIG. 2A, the operating device 26 is a hydraulic pilot type. Specifically, the operating device 26 outputs a pilot pressure commensurate with operation details to a pilot line 27 on its secondary side, using hydraulic oil supplied from the pilot pump 15 through the pilot line 25 and a pilot line 25A branching from the pilot line 25. The pilot line 27 is connected to the control valve 17 via the shuttle valve 32. This allows a pilot pressure commensurate with operation details related to each driven element (hydraulic actuator) in the operating device 26 to be input to the control valve 17 via the shuttle valve 32. Therefore, the control valve 17 can drive each hydraulic actuator according to the details of operation performed on the operating device 26 by the operator or the like.

Furthermore, for example, as illustrated in FIG. 2B, the operating device 26 is an electric type. Specifically, the operating device 26 outputs an electrical signal according to operation details, and the electrical signal is fed into the controller 30. The controller 30 then outputs a control command according to the contents of the electrical signal, namely, the details of operation on the operating device 26, to a proportional valve 31. As a result, a pilot pressure commensurate with the details of operation on the operating device 26 is input from the proportional valve 31 to the control valve 17, so that the control valve 17 can drive each hydraulic actuator according to the details of operation performed on the operating device 26 by the operator or the like.

When the control valves (directional control valves) built in the control valve 17 are an electromagnetic solenoid type, an electrical signal output from the operating device 26 may be directly input to the control valve 17, namely, the control valves of an electromagnetic solenoid type.

As illustrated in FIG. 2A, the shuttle valve 32 includes two inlet ports and one outlet port, and outputs hydraulic oil having the higher one of the pilot pressures input to the two inlet ports to the outlet port. The shuttle valve 32 is provided for each of the driven elements (the crawler 1CL, the crawler 1CR, the upper swing structure 3, the boom 4, the arm 5, and the bucket 6) to be operated with the operating device 26. Of the two inlet ports of the shuttle valve 32, one is connected to the operating device 26 (specifically, a lever device or pedal device included in the operating device 26 as described above) and the other is connected to the proportional valve 31. The outlet port of the shuttle valve 32 is connected to a pilot port of a corresponding control valve (specifically, a control valve corresponding to a hydraulic actuator to be operated with the above-described lever device or pedal device connected to the one of the inlet ports of the shuttle valve 32) in the control valve 17 through a pilot line. Therefore, these shuttle valves 32 can cause the higher one of a pilot pressure generated by the operating device 26 and a pilot pressure generated by the proportional valve 31 to act on a pilot port of a corresponding control valve. That is, the controller 30 as described below can control a corresponding control valve independent of the operator's operation on the operating device 26 by causing a pilot pressure higher than a secondary-side pilot pressure output from the operating device 26 to be output from the proportional valve 31. Accordingly, the controller 30 can automatically control the motion of the driven elements (the lower traveling structure 1, the upper swing structure 3, and the attachment AT) independent of the state of the operator's operation on the operating device 26.

<Control System of Shovel>

The control system of the shovel 100 according to this embodiment includes the controller 30, a processing unit 30E, the proportional valve 31, a space recognition device 70, an orientation detector 71, an input device 72, a positioning device 73, a boom pose sensor S1, an arm pose sensor S2, a bucket pose sensor S3, a machine body tilt sensor S4, and a swing state sensor S5. Furthermore, as illustrated in FIG. 2A, the control system of the shovel 100 according to this embodiment includes an operating pressure sensor 29 when the operating device 26 is a hydraulic pilot type.

The controller 30 is an example of processing circuitry that performs various kinds of control related to the shovel 100. The functions of the controller 30 may be implemented by desired hardware, a combination of desired hardware and software, or the like. For example, the controller 30 is composed mainly of a microcomputer including a CPU (Central Processing Unit), a memory such as a RAM (Random Access Memory), a non-volatile secondary storage such as a ROM (Read Only Memory), and an interface unit. The controller 30 implements various functions by, for example, executing one or more programs installed in the secondary storage on the CPU.

For example, the controller 30 may cause the shovel 100 to operate independent of the operator's operation by controlling the proportional valve 31 based on the operational result of the processing unit 30E, specifically, a drive command for a hydraulic actuator.

One or more of the functions of the controller 30 may be implemented by another controller (control device). That is, the functions of the controller 30 may be distributed among and implemented by multiple controllers.

The processing unit 30E is an example of processing circuitry that performs processing related to various functions of the controller 30 under the control of the controller 30. The processing unit 30E may be implemented by desired hardware or a combination of desired hardware and software. For example, the processing unit 30E includes a GPU (Graphical Processing Unit), an ASIC (Application Specific Integrated Circuit), and an FPGA (field-programmable gate array), and realizes high-speed processing.

For example, the processing unit 30E calculates and generates a drive command for a hydraulic actuator for causing the shovel 100 to automatically operate, based on the output information of one or more or all of the space recognition device 70, the orientation detector 71, the positioning device 73, the sensors S1 through S5, etc.

The proportional valve 31 is provided for each of the driven elements (the crawler 1CL, the crawler 1CR, the upper swing structure 3, the boom 4, the arm 5, and the bucket 6) to be operated with the operating device 26. The proportional valve 31 is provided in the pilot line 25 between the pilot pump 15 and the control valve 17 (a pilot line 25B branching from the pilot line 25 in the case of FIG. 2A), and is configured to be variable in flow area (a cross-sectional area through which hydraulic oil can pass). This enables the proportional valve 31 to output a predetermined pilot pressure to the secondary side, using the hydraulic oil of the pilot pump 15 supplied through the pilot line 25 (the pilot line 25B). Therefore, the proportional valve 31 can cause a predetermined pilot pressure commensurate with a control command from the controller 30 to act on the control valve 17 via the shuttle valve 32 as illustrated in FIG. 2A or directly as illustrated in FIG. 2B. That is, the controller 30 can cause a pilot pressure commensurate with the operation details of the operating device 26 to be supplied from the proportional valve 31 to the control valve 17 to achieve shovel operations based on the operator's operation by outputting an automatic control command corresponding to an electrical signal from the operating device 26 of an electrical type to the proportional valve 31. Furthermore, even when the operating device 26 is not operated by the operator, the controller 30 can automate the shovel 100 by causing a predetermined pilot pressure to be supplied from the proportional valve 31 to the control valve 17.

The space recognition device 70 recognizes (detects) an object present in a three-dimensional space surrounding the shovel 100, and measures a positional relationship such as a distance from the space recognition device 70 or the shovel 100 to the recognized object. Examples of the space recognition device 70 may include an ultrasonic sensor, a millimeter wave radar, a monocular camera, a stereo camera, a depth camera, a LIDAR (Light Detection and Ranging), a distance image sensor, and an infrared sensor. According to this embodiment, the space recognition device 70 includes a forward recognition sensor 70F attached to the front end of the upper surface of the cabin 10, a backward recognition sensor 70B attached to the back end of the upper surface of the upper swing structure 3, a leftward recognition sensor 70L attached to the left end of the upper surface of the upper swing structure 3, and a rightward recognition sensor 70R attached to the right end of the upper surface of the upper swing structure 3. Furthermore, an upward recognition sensor that recognizes an object present in a space above the upper swing structure 3 may be attached to the shovel 100. One or more or all of the backward recognition sensor 70B, the leftward recognition sensor 70L, and the rightward recognition sensor 70R may be omitted depending on the performance of the shovel 100 required for its automatic operation.

The orientation detector 71 detects information on the relative relationship between the orientation of the upper swing structure 3 and the orientation of the lower traveling structure 1 (for example, the swing angle of the upper swing structure 3 relative to the lower traveling structure 1).

The orientation detector 71 may include, for example, a combination of a geomagnetic sensor attached to the lower traveling structure 1 and a geomagnetic sensor attached to the upper swing structure 3. Furthermore, the orientation detector 71 may also include a combination of a GNSS (Global Navigation Satellite System) receiver attached to the lower traveling structure 1 and a GNSS receiver attached to the upper swing structure 3. Furthermore, the orientation detector 71 may also include a rotary encoder, a rotary position sensor, etc., that can detect the swing angle of the upper swing structure 3 relative to the lower traveling structure 1, namely, the above-described swing state sensor S5, and may be, for example, attached to a center joint provided in relation to the swing mechanism 2 that achieves relative rotation between the lower traveling structure 1 and the upper swing structure 3. Furthermore, the orientation detector 71 may also include a camera attached to the upper swing structure 3. In this case, the orientation detector 71 performs known image processing on an image captured by the camera attached to the upper swing structure 3 (an input image) to detect an image of the lower traveling structure 1 included in the input image. The orientation detector 71 may identify the longitudinal direction of the lower traveling structure 1 by detecting an image of the lower traveling structure 1 using a known image recognition technique and derive an angle formed between the direction of the longitudinal axis of the upper swing structure 3 and the longitudinal direction of the lower traveling structure 1. At this point, the direction of the longitudinal axis of the upper swing structure 3 may be derived from the attachment position of the camera. In particular, the crawlers 1C protrude from the upper swing structure 3. Therefore, the orientation detector 71 can identify the longitudinal direction of the lower traveling structure 1 by detecting an image of the crawlers 1C. In the case where the upper swing structure 3 is configured to be driven by an electric motor instead of the swing hydraulic motor 2A to swing, the orientation detector 71 may be a resolver attached to the electric motor.

The input device 72 is provided within the reach of the operator seated in the cabin 10, and receives the operator's various operation inputs. Output signals corresponding to the operation inputs are fed into the controller 30. For example, the input device 72 includes a hardware operation inputting part such as a touchscreen provided on the display of a display device that displays various information images in the cabin 10, a button switch, a lever, and a toggle installed around the display device, and a knob switch provided on the operating device 26. Furthermore, the input device 72 may also include a software operation inputting part operable with a hardware operation inputting part, such as virtual objects of operation (for example, operation icons) displayed in various operation screens displayed on the display device. A signal corresponding to the details of operation on the input device 72 is fed into the controller 30.

The input device 72 includes an automatic control switch 72*a*.

The automatic control switch 72*a* is an operation part used for causing the shovel 100 to automatically perform work. That is, the automatic control switch 72*a* is an operation part for turning on and off the automation function of the shovel 100. Specifically, when the automatic control switch 72*a* is turned on, the controller causes the shovel 100 to automatically perform predetermined work independent of operations from the operating device 26 (see FIGS. 3 through 7).

The positioning device 73 measures the position and the orientation of the upper swing structure 3. The positioning device 73 is, for example, a GNSS compass, and detects the position and the orientation of the upper swing structure 3. A detection signal corresponding to the position and the orientation of the upper swing structure 3 is fed into the controller 30. Furthermore, among the functions of the positioning device 73, the function of detecting the orientation of the upper swing structure 3 may be replaced with a direction sensor attached to the upper swing structure 3.

The positioning device 73 may be omitted depending on the required performance of the shovel 100 related to automatic operation. This is because the position of an object around the shovel 100 detected by the space recognition device 70 can be expressed in a local coordinate system using the shovel 100 as a reference.

A communications device 74 connects to a predetermined communication network that may include, for example, a mobile communication network including a base station as a terminal end, a satellite communication network using a communications satellite, or the Internet to perform communications with apparatuses external to the shovel 100 (for example, a management apparatus 200 as described below).

The boom pose sensor S1 is attached to the boom 4 to detect the pose angle, specifically, elevation angle (hereinafter "boom angle") el, of the boom 4 relative to the upper swing structure 3. The boom pose sensor S1 detects, for example, the angle of a straight line connecting the pivot points of the boom 4 at its both ends to the swing plane of the upper swing structure 3 in a side view. Examples of the boom pose sensor S1 may include a rotary encoder, an acceleration sensor, an angular acceleration sensor, a six-axis sensor, and an IMU (Inertial Measurement Unit), which is hereinafter also the case with the arm pose sensor S2, the bucket pose sensor S3, and the machine body tilt sensor S4. A detection signal corresponding to the boom angle θ1 detected by the boom pose sensor S1 is fed into the controller 30.

The arm pose sensor S2 is attached to the arm 5 to detect the pose angle, specifically, pivot angle (hereinafter "arm angle") θ2, of the arm 5 relative to the boom 4. The arm pose sensor S2 detects, for example, the angle of a straight line connecting the pivot points of the arm 5 at its both ends to the straight line connecting the pivot points of the boom 4 at its both ends in a side view. A detection signal corresponding to the arm angle θ2 detected by the arm pose sensor S2 is fed into the controller 30.

The bucket pose sensor S3 is attached to the bucket 6 to detect the pose angle, specifically, pivot angle (hereinafter "bucket angle") θ3, of the bucket 6 relative to the arm 5. The bucket pose sensor S3 detects, for example, the angle of a straight line connecting the pivot point and the distal end (a blade edge in the case of a bucket) of the bucket 6 to the straight line connecting the pivot points of the arm 5 at its both ends in a side view. A detection signal corresponding to the bucket angle θ3 detected by the bucket pose sensor S3 is fed into the controller 30.

The machine body tilt sensor S4 detects the tilt state of the machine body (for example, the upper swing structure 3) relative to a predetermined reference plane (for example, a horizontal plane). The machine body tilt sensor S4 is, for example, attached to the upper swing structure 3 to detect the tilt angles of the shovel 100 (namely, the upper swing structure 3) about two axes in its longitudinal direction and lateral direction (hereinafter "longitudinal tilt angle" and "lateral tilt angle"). Detection signals corresponding to the tilt angles (longitudinal tilt angle and lateral tilt angle) detected by the machine body tilt sensor S4 are fed into the controller 30.

The swing state sensor S5 is attached to the upper swing structure 3 to output detection information regarding the swing state of the upper swing structure 3. The swing state sensor S5 detects, for example, the swing angular velocity and the swing angle of the upper swing structure 3. Examples of the swing state sensor S5 include a gyroscope, a resolver, and a rotary encoder. The detection information regarding the swing state detected by the swing state sensor S5 is fed into the controller 30.

When the machine body tilt sensor S4 includes a gyroscope, a six-axis sensor, an IMU or the like that can detect angular velocities about three axes, the swing state (for example, the swing angular velocity) of the upper swing structure 3 may be detected based on a detection signal of the machine body tilt sensor S4. In this case, the swing state sensor S5 may be omitted.

As illustrated in FIG. 2A, the operating pressure sensor 29 detects a pilot pressure on the secondary side of the operating device 26 (of the pilot line 27), namely, a pilot pressure commensurate with the state of operation of each driven element (hydraulic actuator) at the operating device 26.

Detection signals of pilot pressures commensurate with the states of operation of the lower traveling structure 1, the upper swing structure 3, the boom 4, the arm 5, the bucket 6, etc., at the operating device 26 generated by the operating pressure sensor 29 are fed into the controller 30.

[Automatic Operation of Shovel]

Next, the automatic operation of the shovel 100 independent of the operator's operation according to this embodiment is described.

<Overview of Automatic Operation of Shovel]

First, an overview of the automatic operation of the shovel 100 according to this embodiment is given.

According to this embodiment, the shovel 100 automatically performs at least one of the work of banking earth and the work of filling with earth under the control of the controller 30 and the processing unit 30E.

For example, the shovel 100 automatically performs leveling work to level out unevenness in a predetermined area that is a target of work (hereinafter "work area"). Specifically, the shovel 100 automatically performs the work of cutting (excavating) elevations and filling depressions with earth in the work area. In this case, the shovel 100 may automatically performs rough leveling work to eliminate relatively large irregularities. Furthermore, the shovel 100 may automatically perform leveling work in the form of performing compaction work, etc., after cutting relatively large elevations and filling in relatively large depressions in the work area, so that the ground in the work area has a predetermined intended shape, that is, matches an intended work surface.

Furthermore, for example, the shovel 100 may automatically perform backfilling work in the case of burying a predetermined object (burial object) in the work area. Specifically, the shovel 100 automatically performs backfilling work to fill a depression such as a groove in which a burial object is placed with earth. In this case, the shovel 100 may automatically perform only backfilling work to fill a depression such a groove in which a burial object is already placed with earth among a series of operations of burial work. Furthermore, the shovel 100 may automatically perform part or the entirety of work other than backfilling work, such as excavation work for forming a depression such as a groove and placement work for placing a burial object (for example, crane work), among a series of operations of burial work. Furthermore, to fill a depression that is an object of backfilling with earth, the shovel 100 may automatically perform only the work of dumping earth in the depression. Furthermore, the shovel 100 may automatically perform leveling work in the form of performing compaction, etc., after dumping earth in a depression and causing the surface of the earth in the depression to be higher than the surrounding ground, so that the surface (ground surface) of the earth in the depression has a predetermined intended shape, that is, matches an intended work surface.

Furthermore, for example, the shovel 100 may automatically perform banking work to bank earth to elevate the ground in the work area. Specifically, the shovel 100 scoops, with the bucket 6, earth carried to an edge of the work area or the periphery of the work area by dump trucks or the like, and dumps the earth from the bucket 6 onto a predetermined location in the work area to elevate the ground of the entire work area. In this case, the shovel 100 may automatically pertain only the work of dumping earth scooped into the bucket 6 onto a predetermined location in the work area and spreading the earth over the entire work area among a series of operations of banking work. Furthermore, the shovel 100 may automatically perform the work of flattening the ground while stamping earth with the crawlers 1C or pressing earth with the back surface of the bucket 6 in the work area, namely, the work of matching the ground with a predetermined intended shape (intended work surface). That is, the shovel 100 may automatically perform part or the entirety of work other than the work of spreading earth over the entire work area among a series of operations of banking work.

Specific examples of the automatic operation of the shovel 100 according to this embodiment are described below.

<First Example of Shovel>

Next, a first example of the automatic operation of the shovel 100 is described with reference to FIG. 3.

Figure 3:
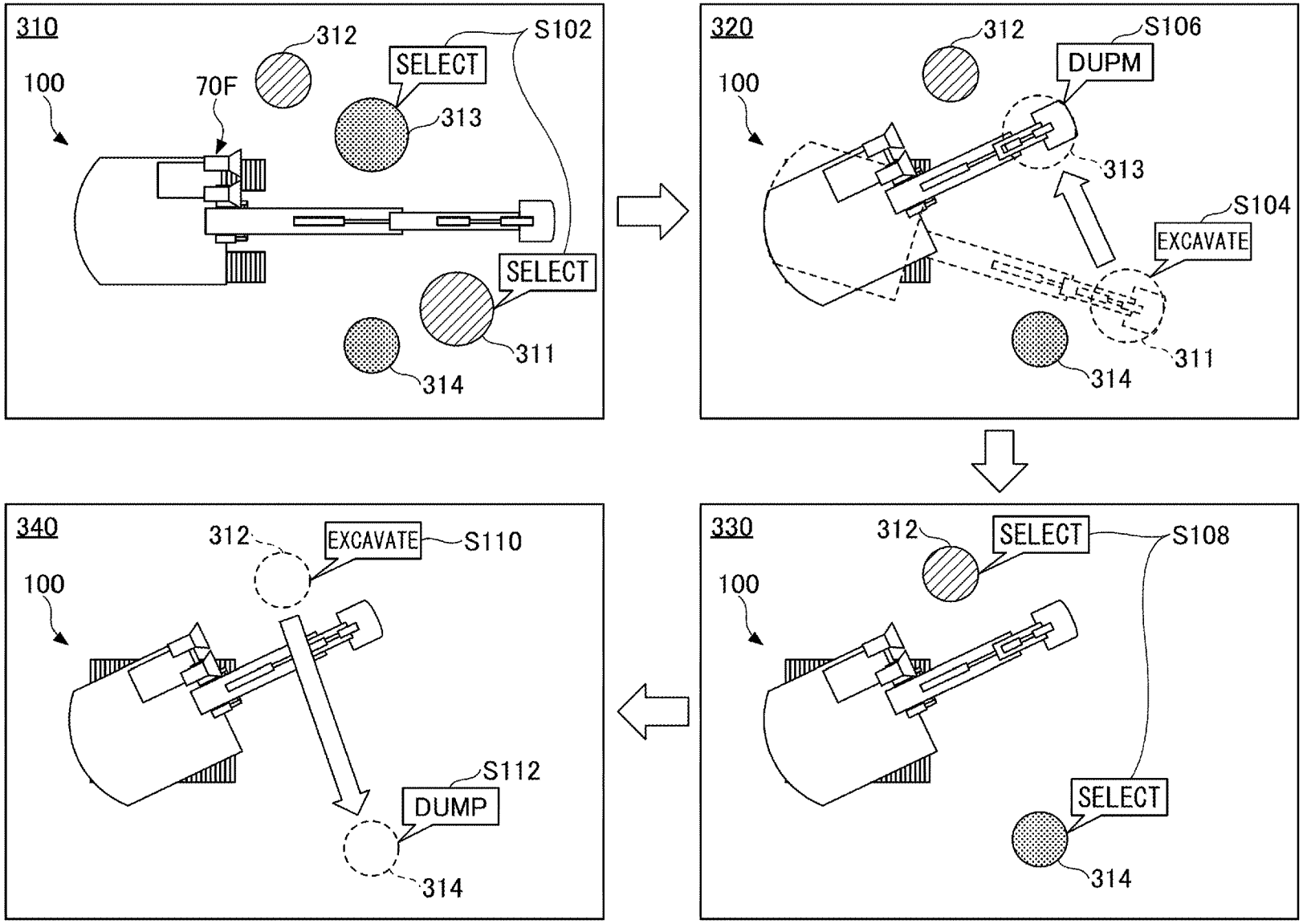
FIG. 3 is a diagram illustrating a first example of the shovel.

FIG. 3 is a diagram illustrating a first example of the shovel 100. Specifically, FIG. 3 is a work state transition diagram illustrating a flow of ground leveling work according to the automatic operation of the shovel 100 according to this example. FIG. 3 illustrates a flow from Work State 310 to Work State 340 in the form of an overhead view from directly above the shovel 100.

According to this example, as illustrated in Work State 310, an area worked on by the shovel 100 (hereinafter "work area") includes elevations 311 and 312 that rise upward relative to an intended work surface serving as a reference and depressions 313 and 314 that are depressed downward relative to the intended work surface. In this case, for example, the work area may be set by a user's operation input through the input device 72 or obtained from an apparatus external to the shovel 100 (for example, the management apparatus 200 or the like described below) through the communications device 74. Furthermore, for example, the work of this example may be uniquely started in response to the automatic control switch 72*a* being turned on or may be started in response to the automatic control switch 72*a* being turned on after the details of work corresponding to this example are selected by an operation input through the input device 72 or an operation input received from an apparatus external to the shovel 100. The same may apply to work according to the automatic operation of a second example through a fifth example of the shovel 100 as described below.

First, in Work State 310, the shovel 100 (the processing unit 30E) recognizes all elevations and depressions (the elevations 311 and 312 and the depressions 313 and 314 according to this example) relative to the intended work surface with respect to the work area based on information on the intended work surface (an example of information on the intended shape of the ground) and the output information of the space recognition device 70 (an example of information on the actual shape of the ground). At this point, for example, the information on the intended work surface may be obtained from the input of the user's operation through the input device 72 or may be obtained from outside the shovel 100 (for example, the management apparatus 200 or the like described below) through the communications device 74. The same may apply to the case of work according to the automatic operation of the second example through the fifth example of the shovel 100 as described below. The shovel 100 (the processing unit 30E) selects one elevation as a source of earth and one depression as a destination of earth from the recognized elevations 311 and 312 and from the recognized depressions 313 and 314, respectively (step S102). Specifically, the shovel 100 (the processing unit 30E) may select one each from the elevations and the depressions such that the amount of earth of the elevation above the intended work surface is relatively close (substantially equal according to this example) to the amount of earth of the depression corresponding to the volume of its depressed portion below the intended work surface. According to this example, the amount of earth of the elevation 311 and the amount of earth of the depression 313 corresponding to the volume of its depressed portion are substantially equal. Therefore, the shovel 100 (the processing unit 30E) selects a combination of the elevation 311 and the depression 313.

Next, in Work State 320, the shovel 100 automatically performs the work of digging the earth of the elevation 311 above the intended work surface, scooping the earth into the bucket 6, and dumping the earth scooped into the bucket 6 in the depression 313 to fill in the depression 313 in sequence under the control of the processing unit 30E and the controller 30 (steps S104 and S106).

When the amount of earth of the elevation 311 is larger than the amount of earth of the depression 313 corresponding to the volume of its depressed portion, the shovel 100 may temporarily place excess earth at a predetermined location and use the excess earth for the next work (the below-described work at step S112) under the control of the processing unit 30E and the controller 30. For example, the shovel 100 may temporarily place excess earth near the next work place (namely, near the depression 314). Furthermore, when the amount of earth of the elevation 311 is smaller than the amount of earth of the depression 313 corresponding to the volume of its depressed portion, the shovel 100 may also dig the earth of another elevation (the elevation 312) to compensate for the shortage with this earth under the control of the processing unit 30E and the controller 30. The same may apply to the case of work according to the automatic operation of the second example through the fifth example of the shovel 100 as described below.

Next, in Work State 330, the shovel 100 (the processing unit 30E) selects one elevation as a source of earth and one depression as a destination of earth (step S108). In Work State 330, only the elevation 312 and the depression 314 remain. Therefore, the shovel 100 (the processing unit 30E) naturally selects a combination of the elevation 312 and the depression 314.

Next, in Work State 340, the shovel 100 autonomously performs the work of digging the earth of the elevation 312 above the intended work surface, scooping the earth into the bucket 6, and dumping the earth scooped into the bucket 6 in the depression 314 to fill in the depression 314 in sequence under the control of the processing unit 30E and the controller 30 (steps S110 and S112). According to this example, the amount of earth of the elevation 312 above the intended work surface and the amount of earth of the depression 314 corresponding to the volume of its depressed portion below the intended work surface are substantially equal. Therefore, the shovel 100 ends the leveling work.

When there is an excess in the earth to fill in the depression 313, that is, when there is excess earth in the work for the entire work area, the shovel 100 may carry the excess earth to a predetermined earth storage place under the control of the processing unit 30E and the controller 30. Furthermore, when there is a shortage of earth to fill in the depression 313, the shovel 100 may move to the earth storage place to carry earth to the work area or may request an external apparatus for transportation of earth to the work area through the communications device 74, under the control of the processing unit 30E and the controller 30. In these cases, the shovel 100 (the processing unit 30E) may, at the start of work, compare the amount of earth required to fill in all depressions with the amount of earth of all elevations and determine whether there may be a shortage or an excess of earth. This allows the shovel 100 to be prepared by bringing necessary earth from the storage place or to determine the amount of excess earth and temporarily place earth at a place from which earth is easily carried to the earth storage place after work (for example, a place relatively close to the storage place in the work area) in advance under the control of the processing unit 30E and the controller 30. The same may apply to the case of work according to the automatic operation of the second example through the fifth example of the shovel 100 as described below.

Thus, according to this example, the shovel 100 repeats the work of individually selecting a combination of an elevation and a depression and filling the depression with the earth of the elevation of the selected combination with respect to elevations and depressions within the work area. This enables the shovel 100 to automatically perform the work of leveling the work area.

<Second Example of Shovel>

Next, a second example of the automatic operation of the shovel 100 is described with reference to FIG. 4.

Figure 4:
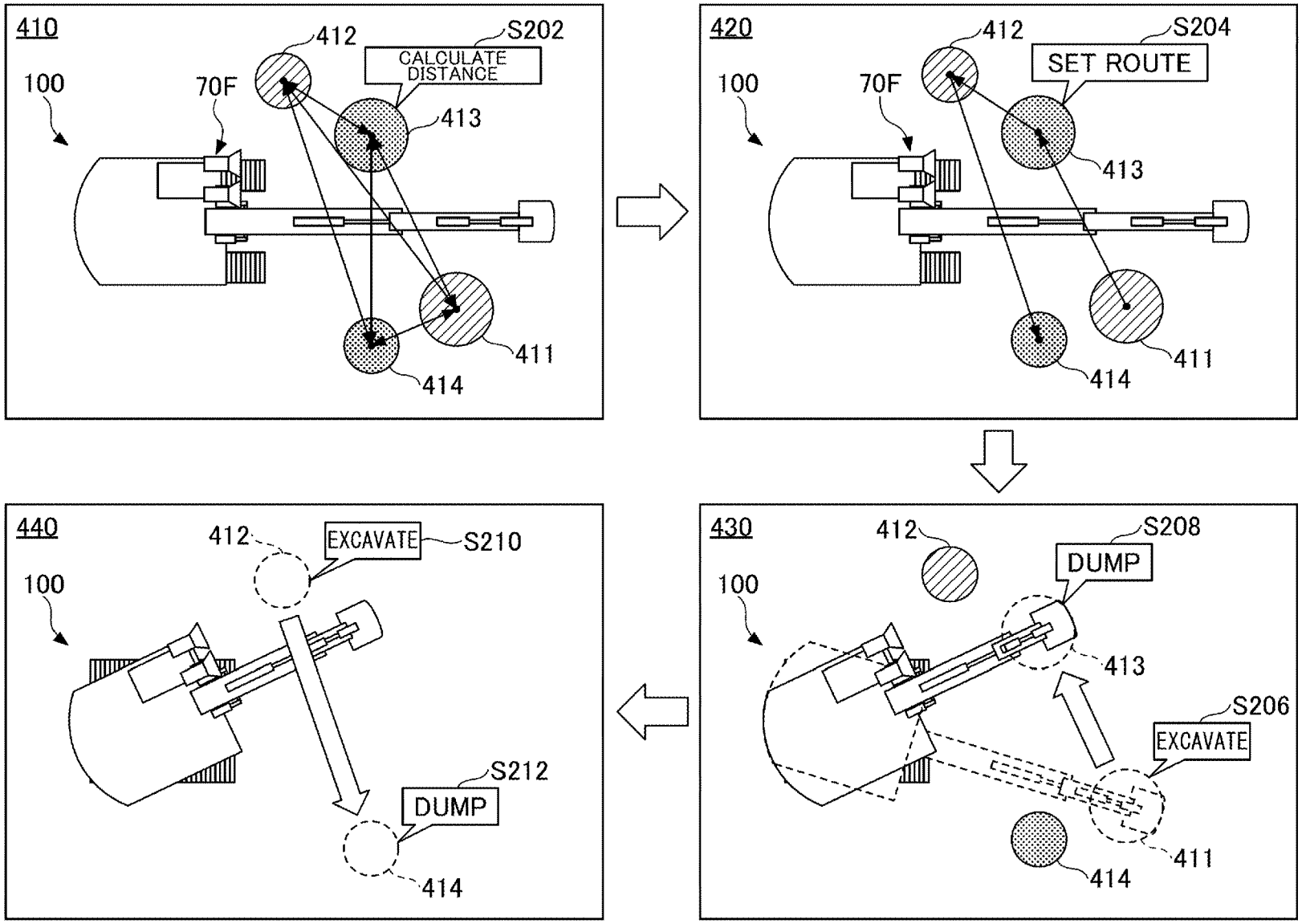
FIG. 4 is a diagram illustrating a second example of the shovel.

FIG. 4 is a diagram illustrating the second example of the shovel 100. Specifically, FIG. 4 is a work state transition diagram illustrating a flow of ground leveling work according to the automatic operation of the shovel 100 according to this example. FIG. 4 illustrates a flow from Work State 410 to Work State 440 in the form of an overhead view from directly above the shovel 100.

According to this example, as illustrated in Work State 410, the work area of the shovel 100 includes elevations 411 and 412 that rise upward relative to an intended work surface serving as a reference and depressions 413 and 414 that are depressed downward relative to the intended work surface.

First, in Work State 410, the shovel 100 (the processing unit 30E) recognizes all elevations and depressions (the elevations 411 and 412 and the depressions 413 and 414 according to this example) relative to the intended work surface with respect to the work area based on the information on the intended work surface and the output information of the space recognition device 70. The shovel 100 (the processing unit 30E) calculates the distances between all the elevations and depressions (step S202). Specifically, the shovel 100 (the processing unit 30E) may define the respective representative positions of the elevations and depressions (for example, their respective central positions or the like assuming that the elevations and depressions are circular in shape in a top plan view), and calculate the distances between the representative positions.

Next, in Work State 420, the shovel 100 (the processing unit 30E) sets a work route such that the work of filling a depression with the earth of an elevation in such a manner as to relatively reduce the travel distance (for example, minimize the travel distance) of the attachment AT (specifically, the bucket 6) is repeated (step S204). At this point, the work route may be set such that the amount of earth of an elevation that is a source of earth is relatively close (for example, substantially equal) to the amount of earth corresponding to the volume of the depressed portion of a depression that is a destination of earth, the same as in the above-described case of the first example. Specifically, the shovel 100 (the processing unit 30E) may determine the work route by applying a known algorithm related to an optimization problem (mathematical programming problem). According to this example, such a travel route is set as to fill the depression 413 with the earth of the elevation 411, move the bucket 6 from the depression 413 to the elevation 412, and fill the depression 414 with the earth of the elevation 412.

Next, in Work State 430, the shovel 100 starts to work along the determined work route under the control of the processing unit 30E and the controller 30. Specifically, the shovel 100 automatically makes a series of motions of digging the earth of the elevation 411 above the intended work surface, scooping the earth into the bucket 6, and dumping the earth scooped into the bucket 6 in the depression 413 to fill in the depression 413 in sequence under the control of the processing unit 30E and the controller 30 (steps S206 and S208). According to this example, the amount of earth of the elevation 411 above the intended work surface and the amount of earth of the depression 413 corresponding to the volume of its depressed portion below the intended work surface are substantially equal. Therefore, there is neither a shortage of earth nor excess earth.

Next, in Work State 440, the shovel 100 continues to work along the determined work route under the control of the processing unit 30E and the controller 30. Specifically, the shovel 100 automatically performs the work of moving the bucket 6 from the depression 413 to the elevation 412, digging the earth of the elevation 412 above the intended work surface, scooping the earth into the bucket 6, and dumping the earth scooped into the bucket 6 in the depression 414 to fill in the depression 414 in sequence under the control of the processing unit 30E and the controller 30 (steps S210 and S212). According to this example, the amount (volume) of earth of the elevation 412 above the intended work surface and the volume of the depressed portion of the depression 414 below the intended work surface are substantially equal. Therefore, the shovel 100 ends the leveling work.

Thus, according to this example, the shovel 100 sets such an overall work route as to repeat the work of filling a depression with the earth of an elevation with respect to depressions and elevations within the work area in advance, and performs leveling work along the determined work route. This enables the shovel 100 to automatically perform the leveling of the work area with efficiency.

<Third Example of Shovel>

Next, a third example of the automatic operation of the shovel 100 is described with reference to FIG. 5.

Figure 5:
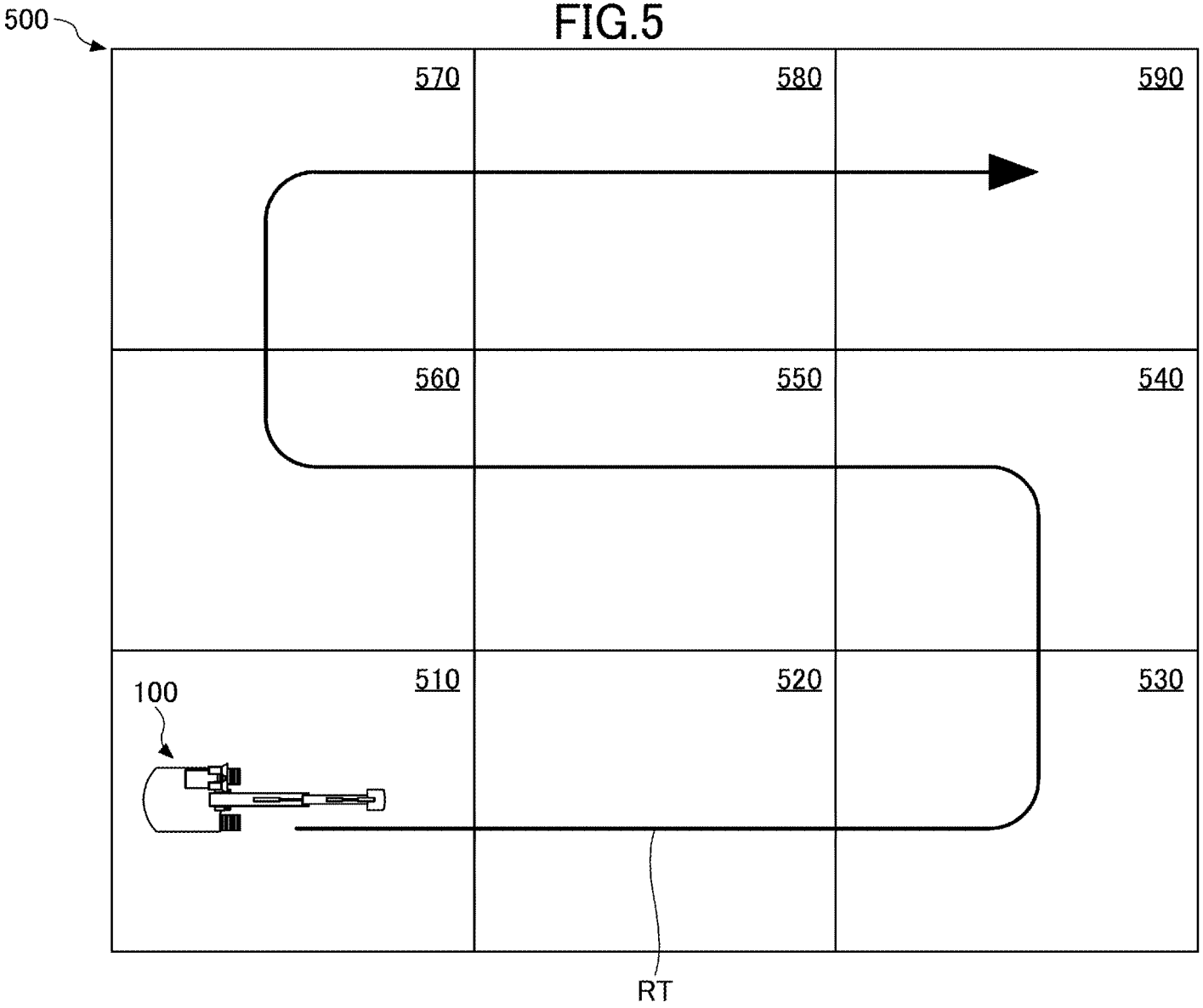
FIG. 5 is a diagram illustrating a third example of the shovel.

FIG. 5 is a diagram illustrating the third example of the shovel 100. Specifically, FIG. 5 is a diagram illustrating how the shovel 100 according to this example performs ground leveling work according to the automatic operation with respect to a relatively wide work area 500.

As illustrating FIG. 5, the work area 500 has a rectangular shape in a plan view, and the rectangular shape is vertically and horizontally trisected into nine relatively narrow work subareas 510 through 590. The work subareas 510 through 590 may be set by, for example, an operation input through the input device 72 or may be set by, for example, an operation input through the communications device 74. The same may apply to a travel route RT described below. According to this example, the shovel 100 repeats a series of operations of completing the leveling of one work subarea and thereafter moving to and performing the leveling of the next work subarea with respect to the work subareas 510 through 590 under the control of the processing unit 30E and the controller 30. At this point, the shovel 100 may perform leveling work in each work subarea by applying the technique of the above-described first example or second example, for instance.

The shovel 100 completes leveling work with respect to each work subarea while moving from the work subarea 510 to the work subarea 590 along the travel route RT, under the control of the processing unit 30E and the controller 30.

Specifically, the travel route RT is so set as to repeat performing work on a work subarea basis while moving straight along one side of the rectangular work area 500 from one work subarea at one end of the work area 500, and in response to completion of work with respect to a work subarea at the other end, moving to an adjacent work subarea along another side of the work area 500 and performing work on a work subarea basis while moving straight in the opposite direction along the one side from this work subarea. That is, the shovel 100 performs leveling work with respect to each work subarea while moving straight back and forth between one end and the other end of the relatively wide work area 500 under the control of the processing unit 30E and the controller 30. This enables the shovel 100 to automatically perform the leveling of the work area 500 with efficiency even when the work area 500 is relatively wide.

The shovel 100 may move along the travel route RT in advance to determine the amount of excess earth or the amount of earth shortage with respect to each work subarea under the control of the processing unit 30E and the controller 30. This enables the shovel 100 to move to an earth storage place to carry earth to the work area 500 or request an external apparatus for transportation of earth to the work area 500 through the communications device 74 in advance under the control of the processing unit 30E and the controller 30 when there is a shortage of earth for the work area 500 as a whole.

When there is excess earth in the leveling of a work subarea, the shovel 100 may temporarily place the excess earth at a place relatively close to the next work subarea. This makes it easier for the shovel 100 to carry the excess earth when moving to the next work subarea, thus making it possible to improve the work efficiency of leveling.

<Fourth Example of Shovel>

Next, a fourth example of the automatic operation of the shovel 100 is described with reference to FIGS. 6A and 6B.

Figure 6A:
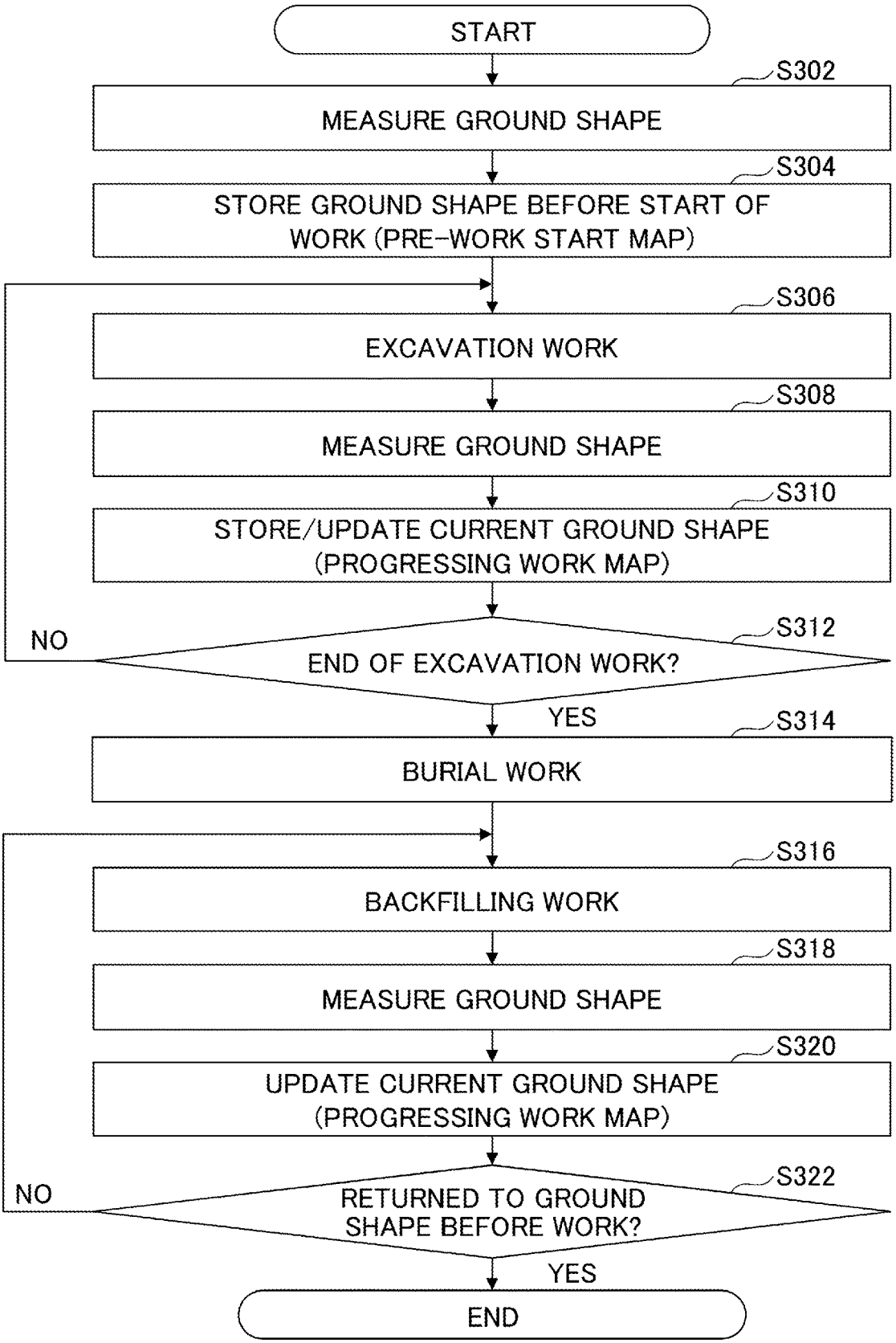
FIG. 6A is a diagram illustrating a fourth example of the shovel.
Figure 6B:
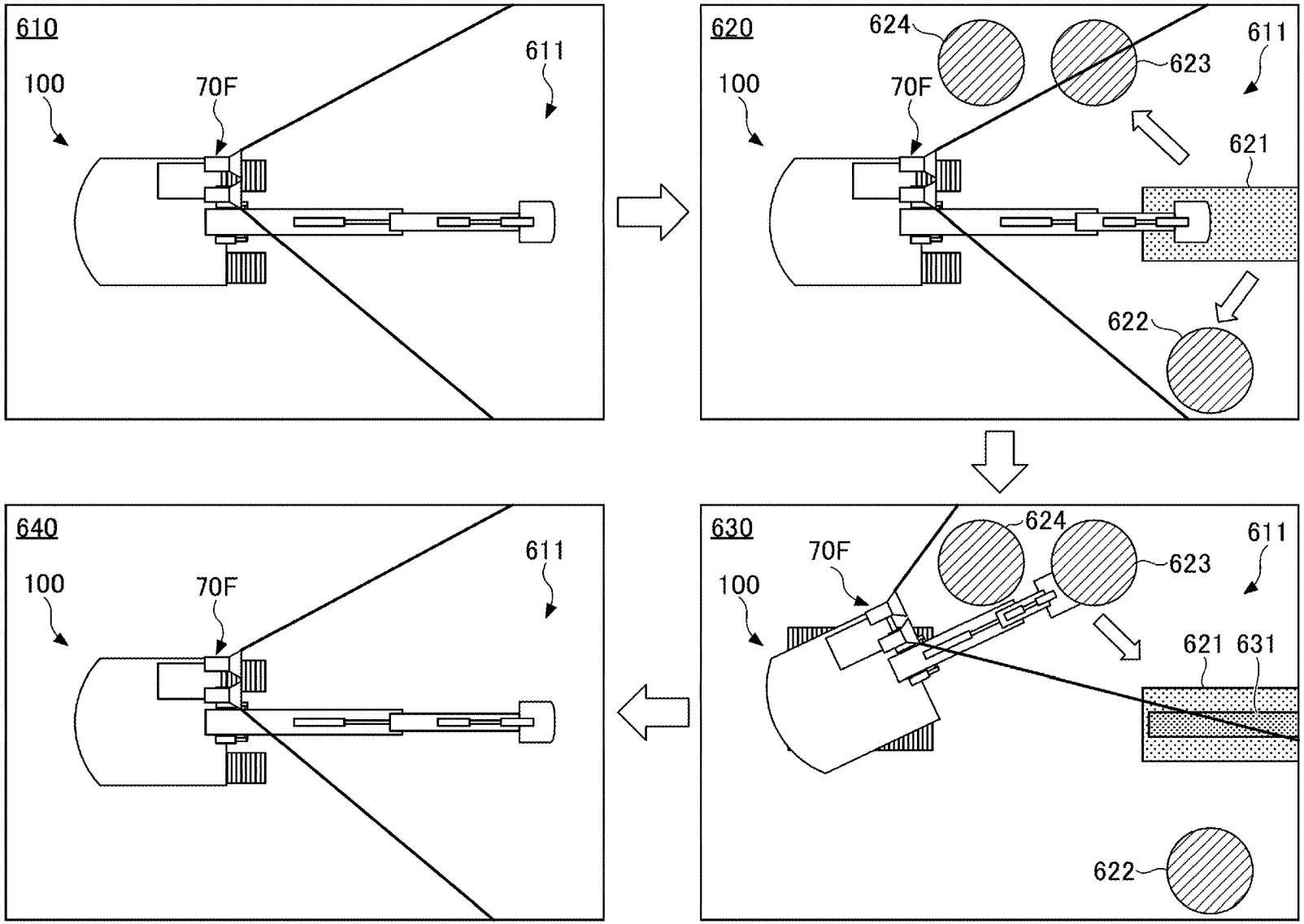
FIG. 6B is a diagram illustrating the fourth example of the shovel.

FIGS. 6A and 6B are diagrams illustrating the fourth example of the shovel 100. Specifically, FIG. 6A is a flowchart schematically illustrating an example of the processing of the controller 30 and the processing unit 30E corresponding to excavation work, burial work, and backfilling work according to the automatic operation of the shovel 100 according to this example. FIG. 6B is a work state transition diagram illustrating a flow of excavation work, burial work, and backfilling work according to the automatic operation of the shovel 100 according to this example. FIG. 6B illustrates a flow from Work State 610 to Work State 640 in the form of an overhead view from directly above the shovel 100. The flowchart of FIG. 6A is executed, for example, when the details of work (namely, a series of operations of excavation work, burial work, and backfilling work) are set through the input device 72 and the automatic control switch 72*a* is thereafter turned on.

As illustrated in FIG. 6A, at step S302, the processing unit 30E obtains data on a ground shape (hereinafter "ground shape data") before the start of work on a work area (for example, a work area 611 of FIG. 6B) (an example of information on an intended shape) using the space recognition device 70 (for example, see Work State 610 of FIG. 6B), and proceeds to step S304.

Instead of obtaining the ground shape data before the start of work using the space recognition device 70, the processing unit 30E may obtain the information on the intended work surface at the time of backfilling work through an operation input from the input device 72, or from an external apparatus, the same as in the above-described case of the first example or the like. Furthermore, the processing unit 30E may obtain the ground shape data before the start of work by outputting a predetermined operation command to trace the shape of the ground before the start of work with the tip of the attachment AT (for example, the teeth tips of the bucket 6) and measure the trajectory of the tip of the attachment AT.

At step S304, the processing unit 30E stores a three-dimensional map including the ground shape data and the position information of the shovel 100 before the start of work (hereinafter, "pre-work start map") in a secondary storage or the like, and proceeds to step S306.

At step S306, the controller 30 causes the shovel 100 to perform the work of excavating the work area by controlling the proportional valve 31 based on a drive command for a hydraulic actuator output from the processing unit 30E. At this point, the processing unit 30E generates a drive command for a hydraulic actuator based on the difference between information on the intended work surface of excavation work and information on the actual ground shape (for example, the output information of the space recognition device 70) and on information on the state of the shovel 100 (for example, the output information of the orientation detector 71, the positioning device 73, the sensors S1 through S5, etc.).

For example, as illustrated in Work State 620 of FIG. 6B, the shovel 100 forms a groove 621 (an example of a depression) for burying a predetermined burial object by excavating the work area 611 under the control of the controller 30 and the processing unit 30E. At this point, the shovel 100 dumps earth stored in the bucket 6 during the digging of the groove 621 onto predetermined dumping locations in the periphery of the work area 611 to form dumped earth mounds 622 and 623 (examples of elevations) under the control of the controller 30 and the processing unit 30E. Furthermore, additional earth 624 (an example of an elevation) to be added for backfilling work is prepared by a transportation truck or the like in the periphery of the work area 611.

Referring back to FIG. 6A, at step S308, the processing unit 30E obtains the ground shape data during working on the work area 611 using the space recognition device 70 in parallel with the excavation work of the shovel 100, and proceeds to step S310.

For example, as illustrated in Work State 620 of FIG. 6B, the shovel 100 (the processing unit 30E) obtains the ground shape data of the work area 611 including the groove 621 that is being dug, the dumped earth mounds 622 and 623, and the additional earth 624, using the space recognition device 70.

Referring back to FIG. 6A, at step S310, the processing unit 30E stores a three-dimensional map including the ground shape data and the position information of the shovel 100 during work obtained at step S308 (hereinafter "progressing work map") in a secondary storage or the like, and proceeds to step S312. At this point, if the progressing work map generated in the process of this step in the past is already stored, the processing unit 30E may update the existing progressing work map to the latest progressing work map.

At step S312, the processing unit 30E determines whether the excavation work has ended based on the information on the intended work surface of excavation work and information on the current ground shape (namely, the progressing work map). If the excavation work has ended, the processing unit 30E proceeds to step S314. If the excavation work has not ended, the processing unit 30E returns to step S306 to repeat the process of steps S306 through S312.

At step S314, the controller 30 causes the shovel 100 to perform burial work to bury a predetermined burial object in a groove, hole, or the like famed by the excavation work based on a drive command output from the processing unit 30E, and proceeds to step S316 when the burial work is finished.

For example, as illustrated in Work State 630 of FIG. 6B, the shovel 100 buries a burial object 631 in the finished groove 621 under the control of the controller 30 and the processing unit 30E.

Referring back to FIG. 6A, at step S316, the controller 30 causes the shovel 100 to perform the backfilling of the groove, hole, or the like in which the burial object is buried by controlling the proportional valve 31 based on a drive command output from the processing unit 30E.

For example, as illustrated in Work State 630 of FIG. 6B, the shovel 100, the shovel 100 performs backfilling work by scooping earth from the dumped earth mounds 622 and 623 with the bucket 6 and dumping the earth in the groove 621 in which the burial object 631 is buried under the control of the controller 30 and the processing unit 30E. Furthermore, if the earth from the dumped earth mounds 622 and 623 alone is insufficient for some reason, the shovel 100 may perform the backfilling of the groove 621 using the additional earth 624 under the control of the controller 30 and the processing unit 30E.

Referring back to FIG. 6A, at step S318, the processing unit 30E obtains the ground shape data during working on the work area 611 (an example of information on the actual shape of the ground) using the space recognition device 70 in parallel with the backfilling work of the shovel 100, and proceeds to step S320.

For example, as illustrated in Work State 630 of FIG. 6B, the shovel 100 (the processing unit 30E) obtains the ground shape data of the work area 611 including the groove 621 that is in the middle of backfilling, the dumped earth mounds 622 and 623, and the additional earth 624 using the space recognition device 70.

Referring back to FIG. 6A, at step S320, the processing unit 30E updates the existing progressing work map stored in a secondary storage or the like based on the ground shape data and the position information of the shovel 100 during work obtained at step S318, and proceeds to step S322.

At step S322, the processing unit 30E determines whether the work area has returned to the ground shape before the start of work based on the pre-work start map and the progressing work map. If the work area has not returned to the ground shape before the start of work, the processing unit 30E returns to step S316 to repeat the process of steps S316 through S322. If the work area has returned to the ground shape before the start of work (see, for example, Work State 640 of FIG. 6B), the processing unit 30E ends the process of this time.

Thus, according to this example, the shovel 100 (the processing unit 30E) obtains the ground shape data before the start of the excavation of the work area in advance. This enables the shovel 100 to automatically perform the backfilling of the work area based on a comparison between the ground shape data before the start of excavation work and the ground shape data during work under the control of the controller 30 and the processing unit 30E.

The excavation work and the burial work may be performed by another shovel. When the excavation work is performed by another shovel, the shovel 100 may automatically perform the backfilling of the work area based on, for example, information on the intended work surface input through the input device 72 or received from an external apparatus and the ground shape data during work under the control of the controller 30 and the processing unit 30E.

<Fifth Example of Shovel>

Next, a fifth example of the automatic operation of the shovel 100 is described.

According to this example, the shovel 100 automatically performs banking work in a relatively narrow work area under the control of the controller 30 and the processing unit 30E.

First, the shovel 100 scoops earth prepared at an end of the work area into the bucket 6, and automatically moves the bucket 6 to the neighborhood of a predetermined location (hereinafter "dumping location") in the work area by traveling on the lower traveling structure 1 or swinging the upper swing structure 3. The earth dumpling location may be, for example, the center of the work area. Then, the shovel 100 moves the attachment AT to automatically dump the earth in the bucket 6 onto the dumping location. As a result, a bank of earth is formed in the work area.

The shovel 100 repeats the work of dumping earth onto the dumping location to form a bank of earth corresponding to the amount of elevation of the ground in the work area.

Next, the shovel 100 automatically (autonomously) performs the work of leveling the bank of earth formed at the dumping location according to the amount of elevation of the ground while obtaining the ground shape data using the space recognition device 70 and recognizing the difference between the actual ground shape and an intended shape (intended work surface). Specifically, the shovel 100 flattens the ground while stamping the earth with the crawlers 1C or pressing the back surface of the bucket 6 against the earth.

For example, in response to determining that the actual ground shape substantially matches the intended shape, the shovel 100 may end the work. Furthermore, if the ground shape with the flattened ground is higher than the intended shape (intended work surface), the shovel 100 may automatically (autonomously) perform the work of cutting (excavating) the ground to adjust the height. In this case, the shovel 100 may scoop the remaining excavated earth into the bucket 6 and automatically move the earth to its original location of placement by traveling on the lower traveling structure 1 or swinging the upper swing structure 3. Furthermore, in response to determining that the ground shape with the flattened ground does not reach the height of the intended shape (intended work surface), the shovel 100 may automatically (autonomously) perform the work of adding earth to the bank. In this case, for example, the shovel 100 automatically performs the work of scooping earth into the bucket 6 from its original location of placement and dumping (adding) the earth onto the work area by traveling on the lower traveling structure 1 or swinging the upper swing structure 3.

Thus, according to this example, the shovel 100 can automatically perform the work of banking earth at a dumping location (one location) within the work area according to the amount of elevation of the ground, among a series of operations of banking work. Furthermore, according to this example, the shovel 100 can also automatically perform the work of flattening earth according to the intended shape (intended work surface) of the ground, specifically such that the ground has a certain height defined by the intended work surface, among a series of operations of banking work.

<Sixth Example of Shovel>

Next, a sixth example of the automatic operation of the shovel 100 is described.

According to this example, the shovel 100 automatically performs banking work in a relatively wide work area under the control of the controller 30 and the processing unit 30E.

First, the shovel 100 automatically performs the work of forming a bank of earth by dumping earth scooped into the bucket 6 onto a dumping location of a subarea with respect to each of subareas set in the work area. Specifically, the shovel 100 delivers earth according to the amount of elevation of the ground to all the subareas by performing the work of completing the work of banking earth in one subarea and thereafter banking earth in the next adjacent subarea. For example, the shovel 100 may perform the work of banking earth subarea by subarea in the same order as in the travel route RT of the above-described third example (FIG. 5).

Next, the shovel 100 automatically (autonomously) performs the work of leveling the bank of earth formed at the dumping location according to the amount of elevation of the ground while obtaining the ground shape data using the space recognition device 70 and recognizing the difference between the actual ground shape and an intended shape (intended work surface) with respect to each subarea. Specifically, the shovel 100 flattens the ground while stamping the earth with the crawlers 1C or pressing the back surface of the bucket 6 against the earth the same as in the above-described case of the fifth example.

The shovel 100 repeats, up to the last subarea, ground leveling work in the form of, for example, ending work in response to determining that the actual ground shape substantially matches the intended shape and moving to the next subarea to start ground leveling work with respect to each subarea. For example, the shovel 100 may perform ground leveling work subarea by subarea in the same order as in the travel route RT of the above-described third example (FIG. 5). Furthermore, if the ground shape with the flattened ground is higher than the intended shape (intended work surface) in a subarea, the shovel 100 may automatically (autonomously) perform the work of cutting (excavating) the ground to adjust the height. In this case, the shovel 100 may scoop the remaining excavated earth into the bucket 6 and automatically move the earth to a subsequent subarea if there is one or to its original location of placement if there is no subsequent area by traveling on the lower traveling structure 1 or swinging the upper swing structure 3. Furthermore, in response to determining that the ground shape with the flattened ground does not reach the height of the intended shape (intended work surface) in a subarea, the shovel 100 may automatically (autonomously) perform the work of adding earth to the bank. In this case, the additional earth may be moved from its original location of placement the same as in the case of the work of forming the initial bank of earth, or may be moved from an adjacent subsequent subarea if there is a subsequent subarea.

Thus, according to this example, the shovel 100 can automatically perform the work of banking earth at a dumping location in each subarea, namely, multiple dumping locations, within the work area according the amount of elevation of the ground, in a series of operations of banking work. Furthermore, according to this example, the shovel 100 can also automatically perform the work of leveling earth according to the intended shape (intended work surface) of the ground (such that the ground has a certain height defined by the intended work surface) with respect to each subarea within the work area, among a series of operations of banking work.

<Seventh Example of Shovel>

Next, a seventh example of the automatic operation of the shovel 100 is described with reference to FIG. 7.

Figure 7:
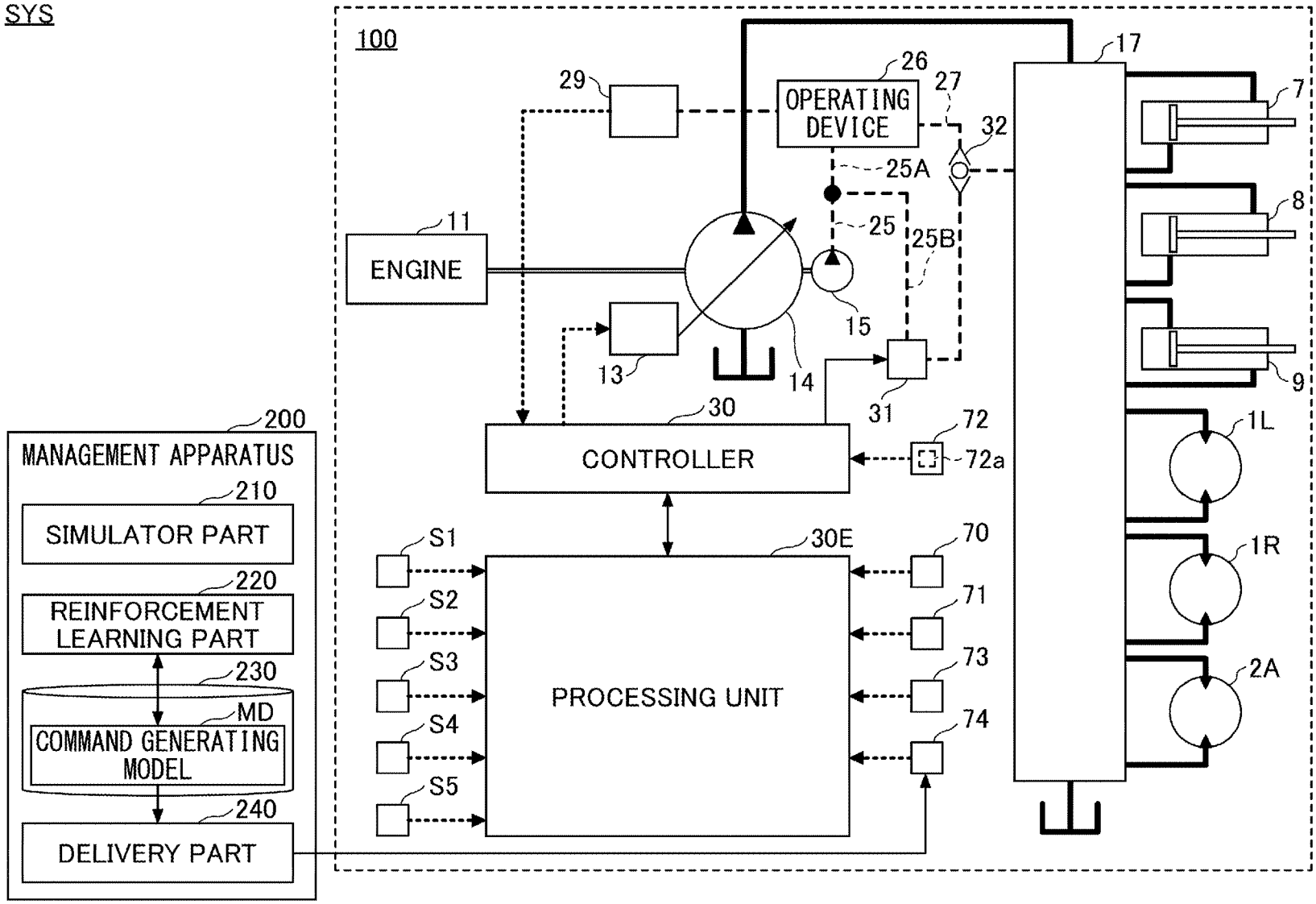
FIG. 7 is a diagram illustrating a seventh example of the shovel.

FIG. 7 is a diagram illustrating the fifth example of the shovel 100. Specifically, FIG. 7 is a diagram illustrating an example configuration of a shovel management system SYS including the shovel 100 according to this example.

In FIG. 7, the configuration of the shovel 100 of FIG. 2A is employed, while the configuration of the shovel 100 of FIG. 2B may be employed.

The shovel management system SYS includes the shovel 100 and the management apparatus 200.

The shovel 100 is connected to the management apparatus 200 in such a manner as to be able to communicate with the management apparatus 200, through a predetermined communication network that includes a mobile communication network including a base station as a terminal end, a satellite communication network using a communications satellite, or the Internet. The shovel 100 autonomously performs predetermined work (for example, the leveling or backfilling of a work area), using a learned model that generates an automatic control command for a hydraulic actuator (hereinafter "command generating model") delivered from the management apparatus 200. In this case, the autonomously performed leveling work may include the work of moving between work subareas as described in the above-described third example.

The management apparatus 200 is connected to the shovel 100 through a predetermined communication network in such a manner as to be able to communicate with the shovel 100, and generates a command generating model for the shovel 100 autonomously performing leveling work, using reinforcement learning and delivers the command generating model to the shovel 100.

The management apparatus 200 may be implemented by desired hardware, a combination of desired hardware and software, or the like. For example, the management apparatus 200 is composed mainly of a server computer (an example of processing circuitry) including a CPU, a processing unit that performs processing under the control of the CPU, such as a GPU, FPGA, ASIC, or the like, a memory such as a RAM, a non-volatile secondary storage such as a ROM, and an interface unit. The management apparatus 200 includes, for example, a simulator part 210, a reinforcement learning part 220, and a delivery part 240 as functional parts implemented by executing one or more programs installed in the secondary storage on the CPU. Furthermore, the management apparatus 200 uses a storage part 230. The storage part 230 may be implemented by, for example, an internal secondary storage, an external storage connected to the management apparatus 200 in such a manner as to be able to communicate with the management apparatus 200, or the like.

The simulator part 210 simulates the operation of the shovel 100 based on input environmental conditions (for example, a work area and a ground shape) and input conditions such as a work pattern with respect to predetermined work (for example, leveling work or backfilling work).

The reinforcement learning part 220 performs reinforcement learning with respect to the predetermined work of the shovel 100 using the simulator part 210, and outputs a command generating model MD for generating an automatic control command in the predetermined work of the shovel 100. The command generating model MD is a learned model that outputs an automatic control command, using environmental conditions (for example, the output information of one or more or all of the space recognition device 70, the orientation detector 71, the positioning device 73, and the sensors S1 through S5) as input information. Specifically, the reinforcement learning part 220 causes an agent to learn behavior (a policy) that maximizes a reward for behavior that contributes to work efficiency, safety, etc., while causing the predetermined work of the shovel 100 to be performed under various environmental conditions using the simulator part 210. A known method of reinforcement learning may be applied to the reinforcement learning part 220 as desired, and deep reinforcement learning that employs a deep neural network (DNN) as compressed representation of a state may be applied.

Furthermore, the reinforcement learning part 220 may generate an additionally trained command generating model MD by further performing additional reinforcement learning using a learned model (command generating model MD) once generated as a starting point. That is, the reinforcement learning part 220 may update the command generating model MD in the storage part 230 based on reinforcement learning.

The reinforcement learning part 220 may also perform reinforcement learning with respect to the predetermined work of the shovel 100 while causing the predetermined work of the shovel 100 to be performed under various environmental conditions, using the actual machine (for example, the shovel 100) instead of the simulator part 210.

The storage part 230 stores the command generating model MD generated by the reinforcement learning part 220.

The delivery part 240 delivers the latest command generating model MD stored in the storage part 230 to the shovel 100. This enables the processing unit 30E of the shovel 100 to generate an automatic control command from the output information of one or more or all of the space recognition device 70, the orientation detector 71, the positioning device 73, the sensors S1 through S5, etc., using the delivered command generating model MD.

Thus, according to this example, the processing unit 30E generates an automatic control command using the command generating model MD based on reinforcement learning. This enables the shovel 100 to autonomously perform predetermined work such as leveling work, backfilling work, or banking work. Furthermore, according to this example, the command generating model MD is generated based on such reinforcement learning as to maximize a reward with respect to work efficiency, safety, etc., as described above. This enables the shovel 100 to achieve more efficient leveling work, backfilling work, banking work, etc., and to achieve safer leveling work, backfilling work, banking work, etc.

<Effects>

Next, effects of the shovel 100 according to this embodiment are described.

According to this embodiment, the shovel 100 automatically performs at least one of the work of banking earth and the work of filling with earth.

This enables the shovel 100 to automatically perform, for example, banking work to elevate the ground, leveling work to level the ground while filling in depressions, burial work to bury a predetermined object, etc.

Furthermore, according to this embodiment, the shovel 100 may automatically perform the work of banking earth or the work of filling with earth such that the ground formed by the earth of the banking or the filling has an intended shape.

This enables the shovel 100 to not only automatically bank earth or fill with earth but also automatically finish the ground such that the ground formed by the banked earth or the filling earth has an intended shape.

Furthermore, according to this embodiment, the shovel 100 may perform at least one of the work of banking earth and the work of filling with earth such that the ground formed by the banked earth or the filling earth in a predetermined area has a certain height.

This enables the shovel 100 to automatically form the ground having a certain height while banking earth or filling with earth in a predetermined area to work on.

Furthermore, according to this embodiment, the shovel 100 may perform at least one of the work of banking earth and the work of filling with earth such that the ground has a certain height, by dumping earth onto multiple positions in the predetermined area.

This enables the shovel 100 to, for example, deliver the amount of earth commensurate with the necessary height of the ground throughout a predetermined area to work on when the predetermined area is relatively wide. Therefore, specifically, the shovel 100 can automatically perform construction work so that the ground has a certain height.

Furthermore, according to this embodiment, the shovel 100 detects (identifies) a depression in the ground based on information on the intended shape of the ground and information on the actual shape of the ground, and fills the depression with the earth.

This enables the shovel 100 to automatically perform the work of filling a depression in the ground with earth.

Furthermore, according to this embodiment, the shovel 100 may detect an elevation of the ground based on the information on the intended shape of the ground and the information on the actual shape of the ground, and fill the depression with the earth of the elevation.

This enables the shovel 100 to automatically perform the work of filling in a depression by filling the depression with the earth of an elevation.

Furthermore, according to this embodiment, the shovel 100 may fill the depression with earth by dumping earth scooped with the bucket 6 in the depression.

This enables the shovel 100 to perform the work of specifically filling in a depression using the bucket 6.

The shovel 100 may also fill in a depression by pushing earth into the depression with the back surface of the bucket 6 (namely, compaction). For example, the processing unit 30E of the shovel 100 may obtain the amount of earth of an elevation using the space recognition device 70, and may scoop the earth into the bucket 6 and dump the earth in the depression when the amount is larger than a predetermined amount and push the earth into the depression with the back surface of the bucket 6 when the amount is less than or equal to the predetermined amount.

Furthermore, according to this embodiment, the shovel 100 may fill the depression with the earth of the elevation, the elevation being relatively close to the depression among depressions in the ground.

This enables the shovel 100 to further simplify the movement of the attachment AT and the upper swing structure 3. Therefore, the shovel 100 can improve work efficiency.

Furthermore, according to this embodiment, the shovel 100 may carry earth from a predetermined storage place to fill in the depression in the ground when the depression is not completely filled with the earth of the elevation.

This enables the shovel 100 to automatically supply necessary earth and complete the work of filling in a depression even when the depression cannot be completely filled with the earth of an elevation in a work area.

Furthermore, according to this embodiment, the shovel 100 may automatically perform the work of filling in the depression in a predetermined area in response to an operation input to the shovel 100 or an operation input received from the outside.

This enables the shovel 100 to automatically perform the work of filling in a depression using an operation in the shovel 100 or an operation input by remote control as a trigger.

Furthermore, according to this embodiment, the shovel 100 may repeat the work of filling in the depression while moving straight in a direction and the work of filling in the depression while moving straight in another direction opposite to the direction in a predetermined area.

This enables the shovel 100 to perform the work of filling in a depression with efficiency even in a relatively wide work area by repeating performing work while moving in one direction from one end to the other end and performing work while moving in the opposite direction from the other end to the one end in a back-and-forth manner.

Furthermore, according to this embodiment, when there is an excess in the earth of the elevation for filling in the depression in the ground, the shovel 100 may move the excess to a predetermined location.

This enables the shovel 100 to, even when there is an excess in the earth of an elevation for filling in a depression in a work area, automatically move the excess to a predetermined location.

Furthermore, according to this embodiment, when there is the excess in the earth of the elevation for filling in the depression in the ground in an area to work on (for example, the work subarea 510 of FIG. 5), the excess may be moved to the predetermined location, the predetermined location being close to the next area to work on (for example, the work subarea 520 of FIG. 5) in the area.

This enables the shovel 100 to, even when there is excess earth in one area, automatically move the excess earth to a location to be easily usable for another area to work on next. Therefore, the shovel 100 can improve work efficiency.

[Variations and Modifications]

An embodiment is described in detail above. The present disclosure, however, is not limited to the specific embodiment, and variations and modifications may be made without departing from the scope of the subject matter described in the claims.

For example, according to the above-described embodiment, the shovel 100 is configured to hydraulically drive all of various moving elements such as the lower traveling structure 1, the upper swing structure 3, the boom 4, the arm 5, and the bucket 6. The shovel 100, however, may also be configured to electrically drive one or more moving elements. That is, the configurations, etc., disclosed in the above-described embodiment may also be applied to hybrid shovels, electric shovels, etc.

Furthermore, according to the above-described embodiment and variations, the operating device 26 may be omitted. That is, according to the above-described embodiment and variations, the shovel 100 may receive no operator's operation and be fully automated.

What is claimed is:

1. A shovel comprising:

a lower traveling structure;

an upper swing structure swingably mounted on the lower traveling structure;

an attachment attached to the upper swing structure and including a boom, an arm, and a bucket;

a space recognition device configured to recognize an object present in a three-dimensional space surrounding the shovel; and processing circuitry configured to detect one or more elevations and one or more depressions relative to an intended shape of a ground in a predetermined area based on information on the intended shape of the ground and output information of the space recognition device, select a combination of an elevation and a depression from the detected one or more elevations and one or more depressions based on a predetermined condition, and cause the shovel to automatically perform work of filling the depression with earth of the elevation by causing the upper swing structure and the attachment to automatically operate.

2. The shovel as claimed in claim 1, wherein the processing circuitry is configured to cause the shovel to automatically perform said work by causing the lower traveling structure to automatically operate.

3. The shovel as claimed in claim 2, wherein the processing circuitry is configured to cause the shovel to repeat (a) performing said work while moving straight in a direction and (b) performing said work while moving straight in another direction opposite to the direction, in the predetermined area.

4. The shovel as claimed in claim 1, wherein the processing circuitry is configured to cause the shovel to automatically perform said work to cause an actual shape of the ground to be the intended shape of the ground by filling the depression with the earth of the elevation.

5. The shovel as claimed in claim 1, wherein the depression and the elevation are at different positions in the predetermined area, and the processing circuitry is configured to cause the shovel to automatically perform the work of filling the depression with the earth of the elevation by moving the earth of the elevation into the depression, so that the ground has a certain height in the predetermined area.

6. The shovel as claimed in claim 5, wherein the processing circuitry is configured to cause the shovel to automatically perform the work of filling said depression and another depression in the predetermined area with the earth of the elevation by dumping the earth of the elevation in the depressions.

7. The shovel as claimed in claim 1, wherein the processing circuitry is configured to cause the shovel to automatically perform the work of filling the depression with the earth of the elevation by pressing said earth into the depression with a back surface of the bucket or by dumping said earth scooped with the bucket in the depression.

8. The shovel as claimed claim 1, wherein the processing circuitry is configured to control the shovel to, when there is an excess in said earth in said work, move the excess to a predetermined location.

9. The shovel as claimed in claim 8, wherein the processing circuitry is configured to control the shovel to, when there is the excess in said earth in said work in an area to work on in the predetermined area, move the excess to the predetermined location, the predetermined location being close to a next area to work on in the predetermined area.

10. The shovel as claimed in claim 1, wherein the processing circuitry is configured to set the predetermined area in response to an operation input to the shovel or an operation input received from an outside.

11. The shovel as claimed in claim 1, wherein the processing circuitry is configured to detect the one or more elevations and the one or more depressions in the ground based on the information on the intended shape of the ground and information on an actual shape of the ground obtained from the output information of the space recognition device, and to cause the shovel to automatically perform the work of filling the depression with the earth of the elevation.

12. The shovel as claimed in claim 1, wherein the predetermined condition is a condition that the elevation of the combination is closer to the depression than any other elevations in the ground.

13. The shovel as claimed in claim 1, wherein the processing circuitry is configured to cause the shovel to further carry earth from a predetermined storage place to fill the depression with the earth of the elevation and the carried earth.

14. The shovel as claimed in claim 1, wherein the processing circuitry is configured to cause the shovel to automatically perform said work in response to an operation input to the shovel or an operation input received from an outside.

* * * * *